US011034158B2

(12) United States Patent
Hamamoto et al.

(10) Patent No.: US 11,034,158 B2
(45) Date of Patent: Jun. 15, 2021

(54) LIQUID EJECTING APPARATUS AND MAINTENANCE METHOD THEREOF

(71) Applicant: SEIKO EPSON CORPORATION, Tokyo (JP)

(72) Inventors: Seiko Hamamoto, Azumino (JP); Satoru Kobayashi, Shiojiri (JP); Toshio Kumagai, Shiojiri (JP); Nobuaki Kamiyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/798,727

(22) Filed: Feb. 24, 2020

(65) Prior Publication Data

US 2020/0269591 A1 Aug. 27, 2020

(30) Foreign Application Priority Data

Feb. 27, 2019 (JP) ..... JP2019-033844

(51) Int. Cl.
*B41J 2/175* (2006.01)
*B41J 2/18* (2006.01)

(52) U.S. Cl.
CPC ..... *B41J 2/17563* (2013.01); *B41J 2/17509* (2013.01); *B41J 2/17523* (2013.01); *B41J 2/17596* (2013.01); *B41J 2/18* (2013.01)

(58) Field of Classification Search
CPC .... B41J 2/175; B41J 2/17509; B41J 2/17523; B41J 2/17563; B41J 2/17596; B41J 29/13; B41J 2/18
See application file for complete search history.

(56) References Cited

U.S. PATENT DOCUMENTS

2015/0217575 A1* 8/2015 Kumagai ..... B41J 2/17566 347/6
2015/0251430 A1* 9/2015 Ishii ..... B41J 2/18 347/30
2016/0167390 A1 6/2016 Nakagawa et al.
2018/0009231 A1 1/2018 Yokozawa et al.
2018/0093491 A1 4/2018 Murayama et al.

FOREIGN PATENT DOCUMENTS

JP 2003-190860 A 7/2003
JP 2004-050443 A 2/2004
JP 2005-131906 A 5/2005
(Continued)

*Primary Examiner* — Anh T Vo
(74) *Attorney, Agent, or Firm* — Workman Nydegger

(57) ABSTRACT

A liquid ejecting apparatus includes: a pump which is provided for a liquid supply path to supply a liquid stored in a liquid storage portion to a liquid ejection portion; a filter portion which is provided between the pump and the liquid ejection portion as a part of the liquid supply path and which includes a filter and a filter chamber defined by the filter into an upstream filter chamber and a downstream filter chamber; a return path coupled to the upstream filter chamber and the liquid storage portion; and a discharge valve located at the return path. While the pump is driven in a non-communication state between the upstream filter chamber and the liquid storage portion, the non-communication state is switched to a communication state therebetween through the return path using the discharge valve.

11 Claims, 9 Drawing Sheets

(56) References Cited

FOREIGN PATENT DOCUMENTS

| | | | |
|---|---|---|---|
| JP | 2006-159482 | A | 6/2006 |
| JP | 2008-238750 | A | 10/2008 |
| JP | 2011-050823 | A | 3/2011 |
| JP | 2016-112761 | A | 6/2016 |
| JP | 2018-008379 | A | 1/2018 |
| JP | 2018-058255 | A | 4/2018 |

* cited by examiner

LIQUID EJECTING APPARATUS AND MAINTENANCE METHOD THEREOF

The present application is based on, and claims priority from JP Application Serial Number 2019-033844, filed Feb. 27, 2019, the disclosure of which is hereby incorporated by reference herein in its entirety.

BACKGROUND

1. Technical Field

The present disclosure relates to a liquid ejecting apparatus and a maintenance method thereof.

2. Related Art

JP-A-2005-131906 has disclosed, as one example of a liquid ejecting apparatus, an ink jet recording apparatus including a valve which opens or closes an ink flow path coupled to an ink container and a recording head and a suction pump which sucks an ink from the recording head. A filter forming the ink flow path suppresses foreign materials, such as aggregates of an ink pigment and air bubbles, from entering from the ink flow path.

Clogging generated in a filter decreases a flow rate of an ink to be supplied to a recording head. In the ink jet recording apparatus described above, in order to suppress the generation of clogging, first, suction is performed while the valve is closed, thereby reducing the pressure of the ink in the flow path. Subsequently, a nozzle of the recording head is opened to the air so as to enable air or the ink to flow back from the nozzle to the filter, thereby removing the foreign materials from the filter. However, in the removal of the foreign materials by enabling air or the ink to flow back from the nozzle to the filter, air may enter the recording head from the nozzle in some cases.

SUMMARY

According to an aspect of the present disclosure, there is provided a liquid ejecting apparatus comprising: a liquid supply path coupled to a liquid ejection portion to supply a liquid stored in a liquid storage portion to the liquid ejection portion; a pump provided for the liquid supply path and configured to supply the liquid to the liquid ejection portion; a filter portion which is provided between the pump and the liquid ejection portion as a part of the liquid supply path and which includes a filter configured to allow the liquid to pass therethrough and a filter chamber defined by the filter into an upstream filter chamber and a downstream filter chamber; a return path coupled to the upstream filter chamber and the liquid storage portion and configured to discharge a liquid in the upstream filter chamber to the liquid storage portion; a discharge valve located at the return path and configured to switch between a communication state in which the upstream filter chamber is in communication with the liquid storage portion and a non-communication state in which the upstream filter chamber is not in communication with the liquid storage portion; and a control portion which switches, while the pump is driven in the non-communication state, the non-communication state to the communication state using the discharge valve.

According to another aspect of the present disclosure, there is provided a maintenance method of a liquid ejecting apparatus which comprises: a liquid supply path coupled to a liquid ejection portion to supply a liquid stored in a liquid storage portion to the liquid ejection portion; a pump provided for the liquid supply path and configured to supply the liquid to the liquid ejection portion; a filter portion which is provided between the pump and the liquid ejection portion as a part of the liquid supply path and which includes a filter configured to allow the liquid to pass therethrough and a filter chamber defined by the filter into an upstream filter chamber and a downstream filter chamber; a return path coupled to the upstream filter chamber and the liquid storage portion and configured to discharge a liquid in the upstream filter chamber to the liquid storage portion; and a discharge valve located at the return path and configured to switch between a communication state in which the upstream filter chamber is in communication with the liquid storage portion and a non-communication state in which the upstream filter chamber is not in communication with the liquid storage portion, and in the maintenance method described above, while the pump is driven in the non-communication state, the non-communication state is switched to the communication state using the discharge valve.

DESCRIPTION OF EXEMPLARY EMBODIMENTS

With reference to FIGS. 1 to 11, one embodiment of a liquid ejecting apparatus and modified examples thereof will be described.

Hereinafter, the entire structure of the liquid ejecting apparatus, the structure of a circulation path, the structure of an upstream damper portion, the structure of a collective flow path member, the structure of a downstream damper portion, the structure of a liquid ejection portion, the composition of a liquid, and a maintenance method will be sequentially described. The liquid ejecting apparatus is, for example, an ink jet type printer which performs printing by ejecting an ink which is one example of the liquid to a medium, such as paper.

Liquid Ejecting Apparatus

Figure 1:
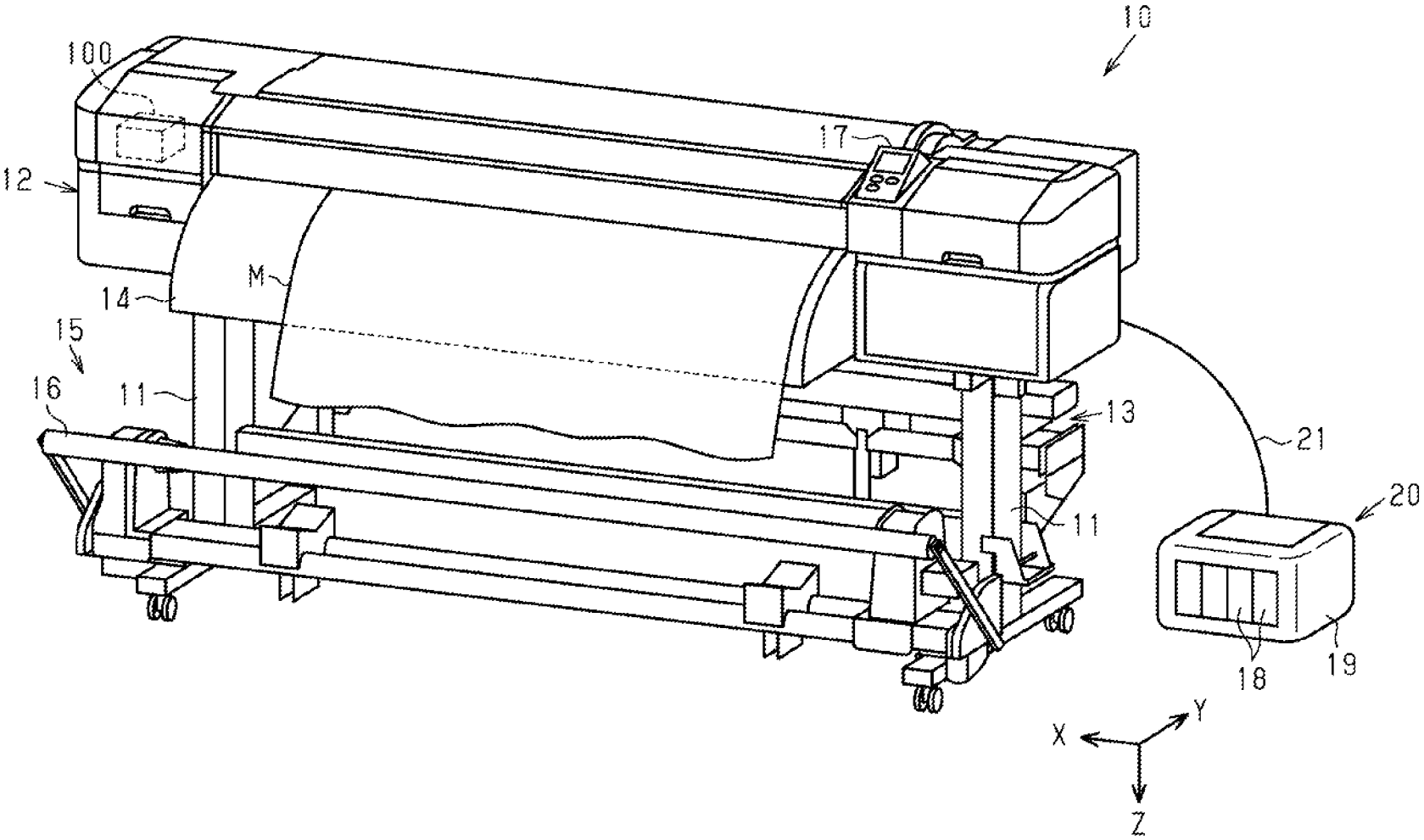
FIG. 1 is a perspective view of a liquid ejecting apparatus according to one embodiment.
Figure 2:
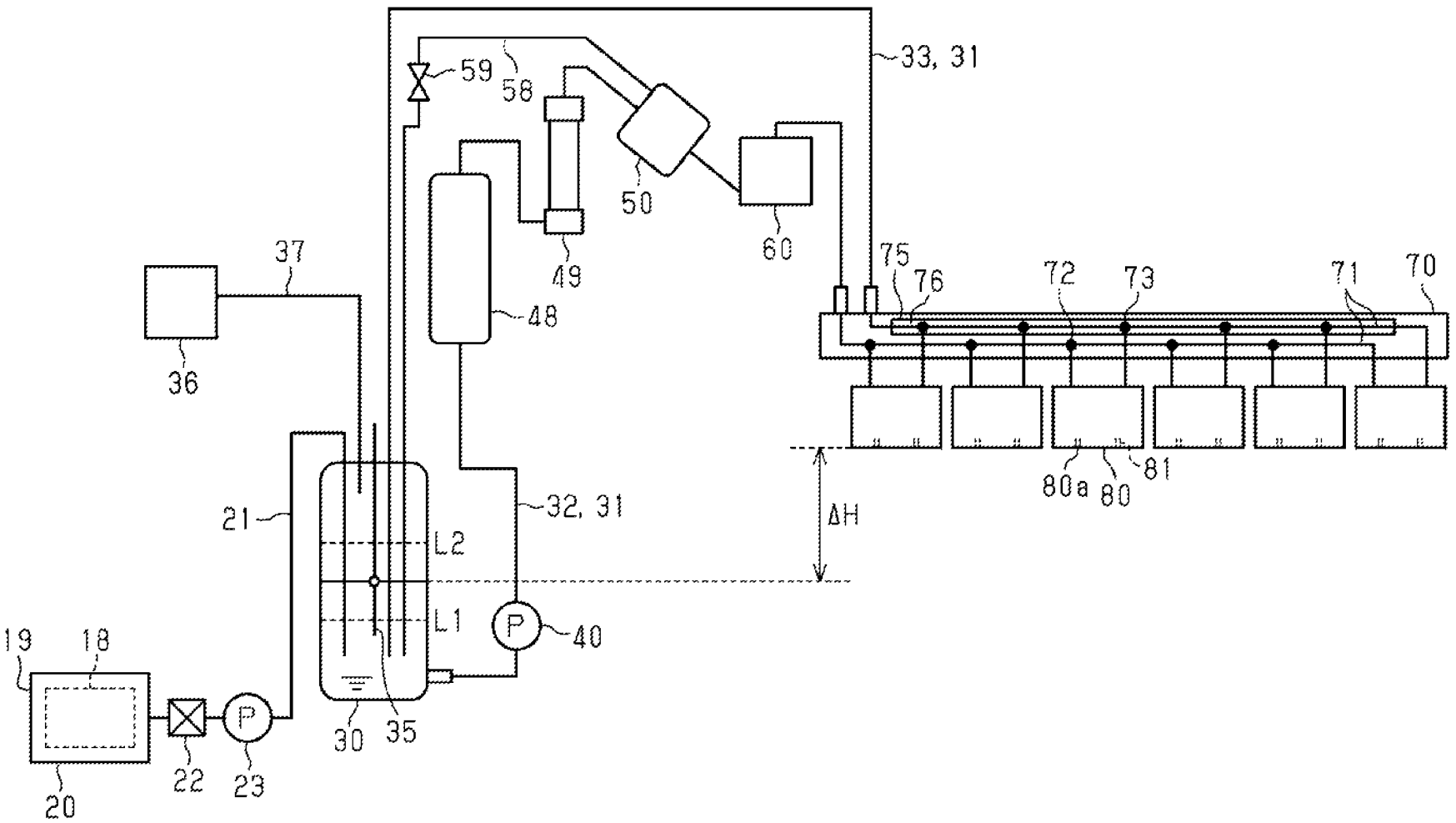
FIG. 2 is an entire structural view of the liquid ejecting apparatus according to the embodiment.

With reference to FIGS. 1 and 2, the entire structure of the liquid ejecting apparatus will be described.

In the following description, based on the assumption in that the liquid ejecting apparatus is placed on a horizontal surface, a vertical direction in which the gravity acts is represented by a Z axis, and directions along the horizontal surface orthogonal to the vertical direction are represented by an X axis and a Y axis. The X axis, the Y axis, and the Z axis are orthogonal to each other. In the following description, the direction along the X axis and the direction along the Y axis may be called a width direction and a depth direction, respectively, in some cases. One end of the liquid ejecting apparatus in the vertical direction may be called an upper surface side or an upper side, and the other end opposite to the one end described above may be called a lower surface side or a lower side in some cases.

As shown in FIG. 1, a liquid ejecting apparatus 10 includes a pair of leg portions 11, a housing 12, a feed portion 13, a guide portion 14, a winding portion 15, a tension application mechanism 16, and an operation panel 17.

The housing 12 is bonded to an upper portion of the pair of leg portions 11. The feed portion 13 feeds a medium M wound around a roll body to the inside of the housing 12. The guide portion 14 guides the medium M discharged from the housing 12 to the winding portion 15.

The winding portion 15 winds the medium M guided by the guide portion 14 around a roll body. The tension application mechanism 16 applies a tension to the medium M wound by the winding portion 15. The operation panel 17 inputs various types of processes to be executed by the liquid ejecting apparatus 10 and conditions of the processes.

The liquid ejecting apparatus 10 includes a main tank 20. The main tank 20 is disposed outside of the housing 12. The main tank 20 includes liquid receiving portions 18 each receiving a liquid and a holder 19 holding the liquid receiving portions 18. The liquid receiving portion 18 is an ink cartridge receiving an ink which is one example of the liquid. The holder 19 detachably holds the liquid receiving portions 18.

The liquid ejecting apparatus 10 includes a control portion 100 to control the operation of the liquid ejecting apparatus 10. The control portion 100 includes, for example, a central processing unit (CPU) and a memory. The CPU is an arithmetic processing device to control a drive portion of the liquid ejecting apparatus 10. The memory is a storage device, such as a RAM and/or an EPROM, having a region in which a program to be carried by the CPU is stored and an operation region in which the program is carried out. Since the program stored in the memory is carried out by the CPU, the control portion 100 controls the operation of the liquid ejecting apparatus 10.

Circulation Path

As shown in FIG. 2, the liquid ejecting apparatus 10 includes a subtank 30, a plurality of liquid ejection portions 80, and a circulation path 31.

The subtank 30 temporarily stores a liquid supplied from the main tank 20. The subtank 30 is one example of a liquid storage portion. The subtank 30 according to this embodiment is an open type subtank 30. The height of the liquid surface in the subtank 30 is a liquid level of the subtank 30.

The liquid ejection portion 80 includes a plurality of nozzles 81 which eject a liquid and a nozzle surface 80*a* in which the nozzles 81 are formed. The distance between the nozzle surface 80*a* and the liquid level of the subtank 30 in the vertical direction is a water head difference ΔH.

The circulation path 31 is a flow path to circulate a liquid. The liquid circulated in the circulation path 31 is supplied from the subtank 30 to each liquid ejection portion 80 and is then returned therefrom to the subtank 30.

The main tank 20 and the subtank 30 are coupled to each other by a supply flow path 21. The supply flow path 21 is a flow path to supply the liquid from the main tank 20 to the subtank 30. An upstream end of the supply flow path 21 is coupled to the main tank 20. A downstream end of the supply flow path 21 is coupled to the subtank 30.

Along the supply flow path 21, a supply on-off valve 22 and a supply pump 23 are disposed in this order from the main tank 20 to the subtank 30. The supply on-off valve 22 is, for example, a solenoid valve to open or close the supply flow path 21. The supply pump 23 allows the liquid received in the main tank 20 to flow to the subtank 30.

The subtank 30 included a liquid level sensor 35. The liquid level sensor 35 detects the liquid level of the subtank 30. The liquid level sensor 35 determines whether or not the liquid level of the subtank 30 is a first liquid level L1 or more. The liquid level sensor 35 determines whether or not the liquid level of the subtank 30 is a second liquid level L2 or more, the second liquid level L2 being higher than the first liquid level L1.

The supply on-off valve 22 and the supply pump 23 supply the liquid from the main tank 20 to the subtank 30 and stop the supply of the liquid.

When the liquid level of the subtank 30 is determined to be less than the first liquid level L1, the supply on-off valve 22 and the supply pump 23 start the supply of the liquid. When the liquid level of the subtank 30 is determined to be the second liquid level L2 or more, the supply on-off valve 22 and the supply pump 23 stop the supply of the liquid. Accordingly, the liquid level of the subtank 30 is maintained from the first liquid level L1 to the second liquid level L2.

In addition, when the liquid ejection portion 80 consumes the liquid, the supply on-off valve 22 and the supply pump 23 may supply the liquid. In addition, the supply on-off valve 22 and the supply pump 23 may supply the liquid so that the pressure of the liquid in the liquid ejection portion 80 is maintained in a predetermined range. According to the liquid supply as described above, while the liquid is circulated in the circulation path 31, the pressure at the nozzle 81 can be maintained in an appropriate range. That is, in the state in which a meniscus, which is a gas-liquid interface, formed at the nozzle 81 is not destroyed, the liquid can be circulated through the circulation path 31.

When the liquid ejecting apparatus 10 performs printing, the inside of the subtank 30 is exposed to the air. The exposure to the air by the subtank 30 adjusts the inside pressure which is the pressure of the inside of the subtank 30. The adjustment of the inside pressure by the subtank 30 is performed so as not to destroy the meniscus formed at the nozzle 81. The inside pressure of the subtank 30 is with respect to the atmospheric pressure, for example, −3,500 to −1,000 Pa. The adjustment of the inside pressure by the subtank 30 is able to stabilize the meniscus at the nozzle 81.

In addition, the adjustment of the inside pressure by the subtank 30 may be performed based on the water head difference ΔH. The supply on-off valve 22 and the supply pump 23 adjust the liquid level of the subtank 30 so that, for example, the water head difference ΔH is 190 mm.

The subtank 30 is coupled to a pressurizing module 36 through an air flow path 37. The air flow path 37 supplies air in the subtank 30 or discharges air therein. The pressurizing module 36 pressurizes the liquid received in the subtank 30 by the air supply through the air flow path 37 or reduces the pressure by air discharge through the air flow path 37.

The pressurizing module 36 is used, for example, for pressure cleaning. The pressure cleaning is performed such that the liquid to be supplied to the nozzle 81 is pressurized so as to be forcibly discharged therefrom. The pressure cleaning discharges foreign materials, such as air bubbles, contained in the liquid from the inside of the liquid ejection portion 80. When the pressure cleaning is performed, the pressurizing module 36 increases the inside pressure of the subtank 30 so as to destroy the meniscus at the nozzle 81.

For example, when the liquid ejecting apparatus 10 performs printing, the pressurizing module 36 may be used to adjust the inside pressure of the subtank 30. The pressurizing module 36 adjusts the inside pressure of the subtank 30 with respect to the atmospheric pressure, for example, to be −2,400 to −1,900 Pa so as not to destroy the meniscus at the nozzle 81. The adjustment of the inside pressure of the subtank 30 by the pressurizing module 36 can also stabilize the meniscus at the nozzle 81.

The circulation path 31 includes a liquid supply path 32 and a liquid discharge path 33.

The liquid supply path 32 is coupled to the liquid ejection portions 80 and the subtank 30. The liquid ejection portions 80 are coupled in parallel to the liquid supply path 32. The liquid supply path 32 supplies the liquid from the subtank 30 to the liquid ejection portions 80. An upstream end of the liquid supply path 32 is coupled to the subtank 30. A downstream end of the liquid supply path 32 is a part of a collective flow path member 70 and is coupled to the liquid ejection portions 80.

The liquid discharge path 33 is coupled to the liquid ejection portions 80 and the subtank 30. The liquid ejection portions 80 are coupled in parallel to each other to the liquid discharge path 33. The liquid discharge path 33 returns a part of the liquid supplied to the liquid ejection portions 80 to the subtank 30. That is, of the liquid supplied to the liquid ejection portions 80, a liquid which is not ejected from the nozzles 81 of the liquid ejection portions 80 are returned to the subtank 30 through the liquid discharge path 33. An upstream end of the liquid discharge path 33 is a part of the collective flow path member 70 and is coupled to the liquid ejection portions 80. A downstream end of the liquid discharge path 33 is coupled to the subtank 30.

The liquid supply path 32 is coupled to one end portion of each liquid ejection portion 80. The liquid discharge path 33 is coupled to the other end portion of each liquid ejection portion 80 different from the one end portion thereof. The liquid ejection portions 80 are coupled in parallel to each other from parts of the liquid supply path 32 included in the collective flow path member 70 to parts of the liquid discharge path 33 included therein.

Along the liquid supply path 32, a diaphragm pump 40, a heating portion 48, a deaeration portion 49, a filter portion 50, an upstream damper portion 60, and a part of the collective flow path member 70 are disposed in this order from the subtank 30 to the liquid ejection portions 80.

The diaphragm pump 40 is one example of a pump. The diaphragm pump 40 supplies the liquid to the liquid ejection portions 80 through the liquid supply path 32.

Figure 3:
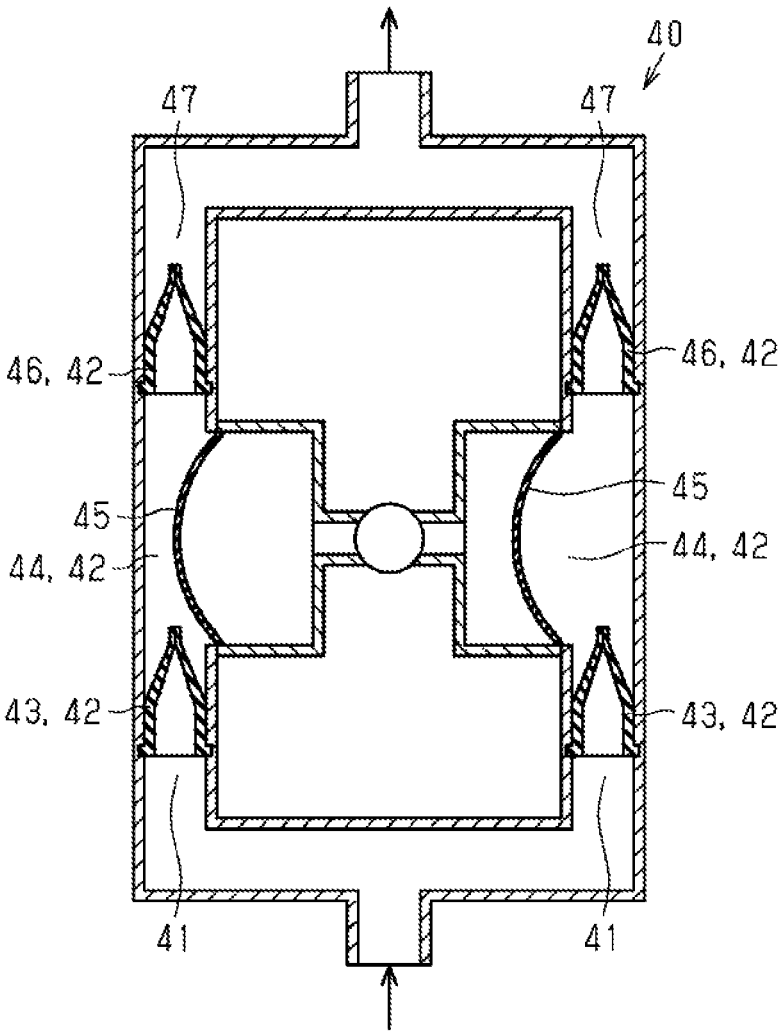
FIG. 3 is a cross-sectional view of a pump of the liquid ejecting apparatus shown in FIG. 1.

As shown in FIG. 3, the diaphragm pump 40 includes a suction side flow path 41, a pump portion 42, a diaphragm 45, and a discharge side flow path 47. The pump portion 42 includes a one-way valve 43 at a suction side flow path 41 side, a diaphragm chamber 44, and a one-way valve 46 at a discharge side flow path 47 side. The one-way valve is at least one selected from a duckbill valve, an umbrella valve, and a leaf valve. In this embodiment, a two-phase type example in which the diaphragm pump 40 includes two pump portions 42 and in which the pump portions 42 each include two duckbill valves as the one-way valve will be described.

The suction side flow path 41 is coupled to a lower side of the diaphragm chamber 44 so as to extend in the vertical direction. The discharge side flow path 47 is coupled to an upper side of the diaphragm chamber 44 so as to extend in the vertical direction. The diaphragm chamber 44 is disposed so that the diameter direction of the diaphragm 45 is disposed in a vertical surface.

Accordingly, the diaphragm pump 40 is likely to discharge air bubbles contained in the liquid.

The pump portion 42 performs an operation of sucking the liquid through the suction side flow path 41 and an operation of discharging the liquid through the discharge side flow path 47 as a series of operations. Between the series of operations performed by one pump portion 42 and the series of operations performed by the other pump portion 42, the phases are shifted by 180°. Accordingly, when the one pump portion 42 sucks the liquid, since the other pump portion 42 is able to discharge the liquid, the variation of the pressure generated in each pump portion 42 can be reduced by cooperation between the two pump portions 42. The liquid supply volume per unit time by the diaphragm pump 40 is, for example, approximately 0.4 $cm^3/s$.

At least a part of the diaphragm pump 40 is preferably located at a lower side than the liquid level of the subtank 30. In the diaphragm pump 40, the center of the diaphragm chamber 44 in the vertical direction is more preferably located at a lower side than the liquid level of the subtank 30. When a suction port of the diaphragm pump 40 is lower than the liquid level of the subtank 30, the cavitation is suppressed from being generated, and the supply of the liquid by the diaphragm pump 40 can be stabilized.

When the one-way valves 43 and 46 each composed of a rubber material are left for a long time in a liquid discharged state, while the opening of the one-way valve is closed, tongue pieces thereof are adhered to each other in some cases. Hence, in order to supply the liquid from the subtank 30 to the diaphragm pump 40, the pressurizing module 36 may increase the inside pressure of the subtank 30. Alternatively, in order to supply the liquid from the subtank 30 to the diaphragm pump 40, the liquid may be forcibly sucked from the nozzles 81. Accordingly, the openings of the one-way valves 43 and 46 are forcibly opened, and the adhesion thereof can be overcome. The treatment as described above may be performed before or during the operation of filling the liquid in the liquid ejection portions 80.

The heating portion 48 includes a hot water tank containing a heater and a thermometer, a hot water circulation path, a hot water pump, and a heat exchanger. The hot water tank receives hot water controlled in a predetermined temperature range. The hot water circulation path is a flow path which starts from and returns to the hot water tank via the heat exchanger. The hot water pump circulates hot water in the hot water circulation path. The heat exchanger performs heat exchange between the how water flowing in the hot water circulation path and the liquid flowing in the circulation path 31.

The heating portion 48 heats the liquid flowing in the circulation path 31 to a predetermined temperature. The predetermined temperature is a temperature at which the liquid to be supplied to the liquid ejection portions 80 has a viscosity suitable for ejection from the liquid ejection portion 80 and is, for example, 35° C. to 40° C. The heating portion 48 suppresses the supply of a liquid having a high viscosity which is not suitable for ejection to the liquid ejection portions 80.

The deaeration portion 49 deaerates the liquid flowing in the circulation path 31. The deaeration portion 49 includes a deaerator and a negative pressure pump. The deaerator includes, for example, a plurality of hollow fiber membranes. Since an outside pressure of the hollow fiber membranes is reduced by the negative pressure pump, the liquid flowing in the hollow fiber membranes are deaerated. The deaeration portion 49 suppresses the supply of a liquid containing air bubbles to the liquid ejection portions 80.

The filter portion 50 is located, in the liquid supply path 32, between the deaeration portion 49 and the upstream damper portion 60. The filter portion 50 is located at an upper side than the nozzle surface 80*a* of the liquid ejection portion 80 in the vertical direction. The filter portion 50 is configured to be detachable to the liquid supply path 32.

Figure 4:
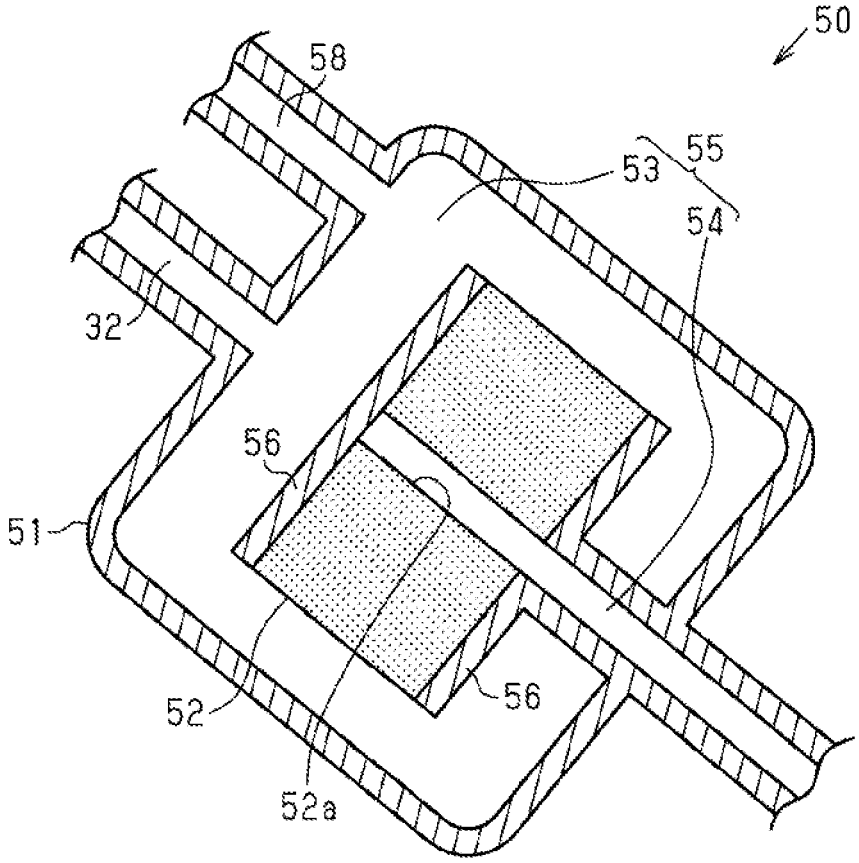
FIG. 4 is a cross-sectional view of a filter portion of the liquid ejecting apparatus shown in FIG. 1.

As shown in FIG. 4, the filter portion 50 includes a cylindrical hollow case 51. A filter 52 has a cylindrical hollow shape coaxial with the case 51 and is disposed therein. The liquid supply path 32 is coupled to a round bottom wall and a round top wall of the case 51.

The filter portion 50 includes the filter 52 which allows the liquid to pass therethrough and a filter chamber 55. The filter chamber 55 forms a part of the liquid supply path 32. The filter chamber 55 is composed of an upstream filter chamber 53 and a downstream filter chamber 54, which are defined by the filter 52.

The upstream filter chamber 53 is located upstream of the liquid supply path 32 than the downstream filter chamber 54. The upstream filter chamber 53 is provided between the top wall of the case 51 and the filter 52. The liquid deaerated by the deaeration portion 49 flows in the upstream filter chamber 53.

The filter 52 is a cylindrical hollow body having a round filter flow path 52*a*. A bottom surface and a top surface of the filter 52 are each covered with a round support plate 56. A top end of the filter flow path 52*a* is closed by a top surface-side support plate 56. A bottom end of the filter flow path 52*a* communicates with the downstream filter chamber 54 through a hole penetrating a bottom surface-side support plate 56.

When the liquid flows in the filter portion 50, the liquid is temporarily stored in the upstream filter chamber 53. The liquid stored in the upstream filter chamber 53 enters the filter 52 from an outer circumference surface thereof and flows to the filter flow path 52*a*. At this stage, the foreign materials, such as air bubbles, in the liquid are trapped by the filter 52. The liquid filtrated by the filter 52 moves to the downstream filter chamber 54 through the filter flow path 52*a* and flows to the liquid supply path 32 located downstream than the filter portion 50.

Besides the liquid supply path 32, a deaeration path 58 is also coupled to the upstream filter chamber 53. The deaeration path 58 is one example of a return path and is coupled to the upstream filter chamber 53 and the subtank 30. A discharge valve 59 is disposed at a certain portion of the deaeration path 58. The deaeration path 58 is coupled to the upstream filter chamber 53 at the topmost position in the vertical direction.

The discharge valve 59 opens or closes the deaeration path 58. The filter portion 50 communicates with the subtank 30 through the opened deaeration path 58. A gas in the filter portion 50 is discharged to the subtank 30 through the opened deaeration path 58. The filter portion 50 is not allowed to communicate with the subtank 30 through the closed deaeration path 58.

When the discharge valve 59 disposed at the deaeration path 58 is closed, the foreign materials, such as air bubbles, trapped by the filter 52 stay at an upper portion of the upstream filter chamber 53. The air bubbles staying at the upper portion of the upstream filter chamber 53 are discharged to the subtank 30 through the deaeration path 58 which is opened by the discharge valve 59.

In this embodiment, the filter portion 50 is slantingly disposed so that an upstream of the filter portion 50 is higher than a downstream thereof. The deaeration path 58 may be coupled to an upper end side of the upstream filter chamber 53 in the vertical direction. Accordingly, a gas entering the upstream filter chamber 53 stays at a corner portion located at the highest position of the upstream filter chamber 53, and hence, the gas is more likely to enter the deaeration path 58 than the liquid.

In addition, in association with the variation of the pressure in the liquid, the volume of the air bubbles staying at the upper portion of the upstream filter chamber 53 is changed. Hence, by the gas staying in the filter portion 50, in the liquid supply path 32, the variation of the pressure in the liquid can be suppressed.

Figure 5:
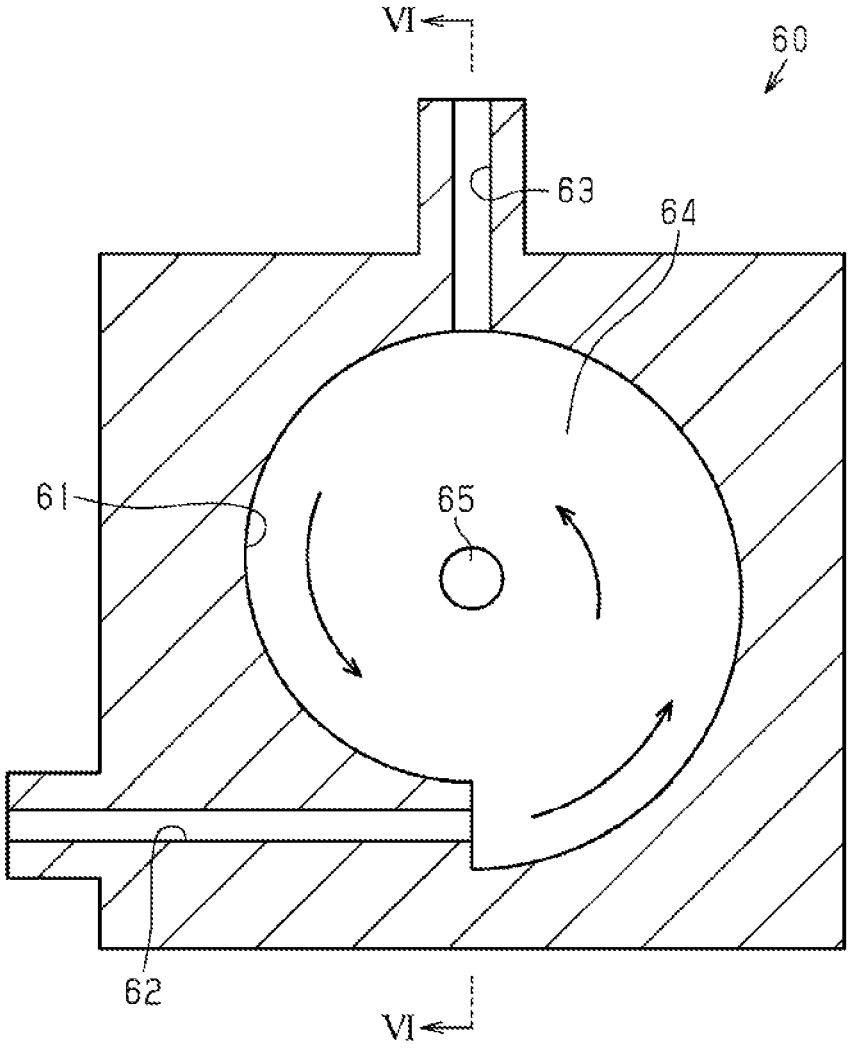
FIG. 5 is a cross-sectional view of an upstream damper portion of the liquid ejecting apparatus shown in FIG. 1.
Figure 6:
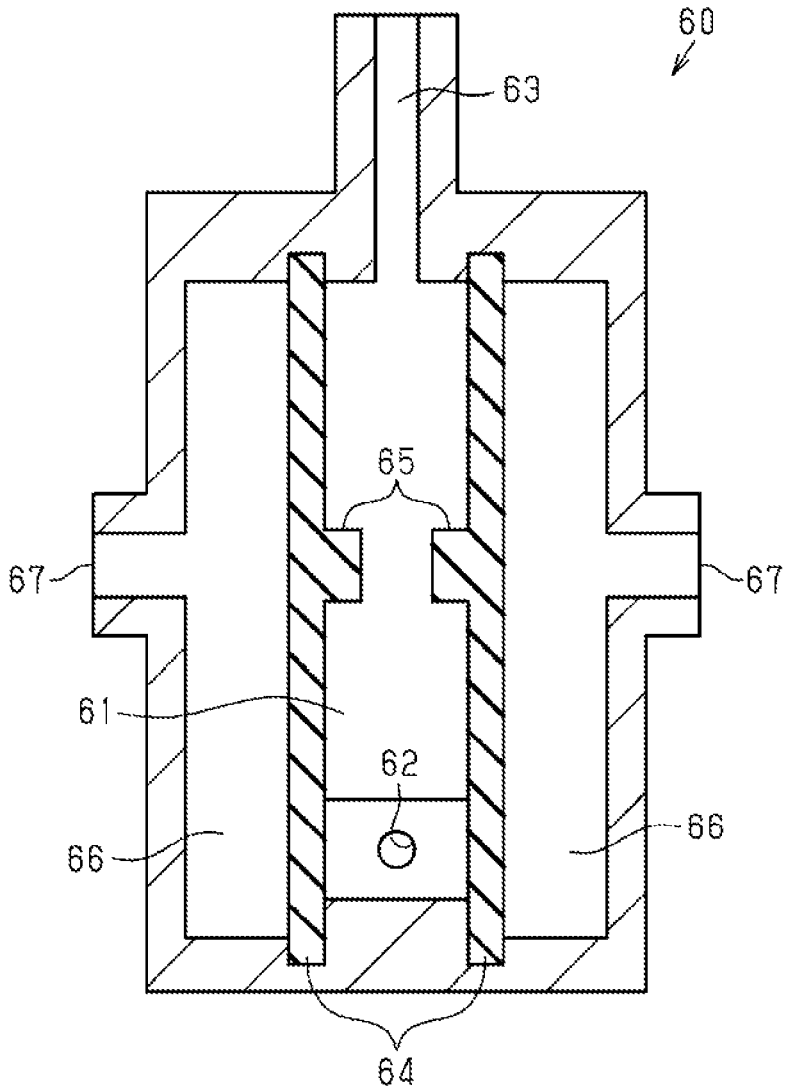
FIG. 6 is a cross-sectional view of the structure of the upstream damper portion taken along the line VI-VI shown in FIG. 5.

With reference to FIGS. 5 and 6, the upstream damper portion of the liquid ejecting apparatus will be described in more detail. FIG. 5 is a cross-sectional view of the upstream damper portion 60. FIG. 6 is a cross-sectional view of the structure of the upstream damper portion 60 taken along the line VI-VI shown in FIG. 5. The upstream damper portion 60 is located at a lower side than the filter portion 50 in the vertical direction. The upstream damper portion 60 is located at an upper side than the nozzle surface 80*a* of the liquid ejection portion 80 in the vertical direction.

As shown in FIG. 5, the upstream damper portion 60 is provided between the diaphragm pump 40 and the liquid ejection portions 80 as a part of the liquid supply path 32. In addition, as shown in FIG. 5, the upstream damper portion 60 includes an upstream damper chamber 61, an inlet path 62 through which the liquid flows in the upstream damper chamber 61, and an outlet path 63 through which the liquid is discharged from the upstream damper chamber 61.

As shown in FIG. 6, the upstream damper portion 60 includes a pair of gas chambers 66. The gas chambers 66 each has a communication portion 67 which communicates with the outside. The inside of the gas chamber 66 is opened to the air through the communication portion 67. The communication portion 67 may be coupled, for example, to a waste liquid tank not shown. The gas chambers 66 are separated from the upstream damper chamber 61 by flexible membranes 64. The upstream damper chamber 61 is provided between the two gas chambers 66.

The upstream damper chamber 61 includes a pair of the flexible membranes 64 having a rubber elasticity. The pair of the flexible membranes 64 is a part of a wall defining the upstream damper chamber 61. The upstream damper chamber 61 has an annular inner wall. The annular inner wall surrounds the peripheries of the flexible membranes 64. The two flexible membranes 64 surrounded by the inner wall face each other. The upstream damper portion 60 is placed so that the flexible membranes 64 face each other in a horizontal direction.

The inlet path 62 of the upstream damper portion 60 is located upstream of the liquid supply path 32. The inlet path 62 allows the liquid supplied from the downstream filter chamber 54 to flow to the inside of the upstream damper chamber 61.

The outlet path 63 of the upstream damper portion 60 is located downstream of the liquid supply path 32. The outlet path 63 allows the liquid to flow from the inside of the upstream damper chamber 61 to the outside thereof.

Of the surfaces defining the upstream damper chamber 61, a surface in which the outlet path 63 is opened is different from a surface in which the inlet path 62 is opened, and the outlet path 63 is not located at a position to which the inlet path 62 extends to the upstream damper chamber 61. The direction in which the inlet path 62 extends is a direction in which the liquid flows into the upstream damper chamber 61.

The opening of the inlet path 62 is located at a lower side than the center of the upstream damper chamber 61 in the vertical direction. In this embodiment, the inlet path 62 extends in the horizontal direction, and the opening of the inlet path 62 is located at a bottom portion of the upstream damper chamber 61.

The opening of the outlet path 63 is located at an upper side than the center of the upstream damper chamber 61 in the vertical direction. When the opening of the outlet path 63 is configured to be located at an upper side than the center of the upstream damper chamber 61 in the vertical direction, air bubbles can be easily discharged from the inside of the upstream damper chamber 61. In this embodiment, the outlet path 63 extends in the vertical direction, and the opening of the outlet path 63 is located at a top portion of the upstream damper chamber 61.

In the upstream damper chamber 61, the liquid flowing from the inlet path 62 flows along the annular inner wall provided between the pair of the flexible membranes 64. The opening of the inlet path 62 is located at a lower side than the center of the upstream damper chamber 61 in the vertical direction so that the liquid flows along the annular inside wall. On the other hand, the opening of the outlet path 63 is located at an upper side than the center of the upstream damper chamber 61 in the vertical direction so as to face an upper side.

Accordingly, the direction of the flow of the liquid in the upstream damper chamber 61 is changed from the flow into the inlet path 62 to the flow out of the outlet path 63. Since the flow of the liquid in the upstream damper chamber 61 is not linear, in the upstream damper chamber 61, an effect of suppressing the variation of the pressure in the liquid can be enhanced.

In addition, in the upstream damper chamber 61, a liquid component may precipitate in some cases. However, since the inlet path 62 is opened at a lower side than the center of the upstream damper chamber 61 in the vertical direction, the flow of the liquid into the upstream damper chamber 61 stirs the liquid therein, thereby suppressing the precipitation of the liquid component.

The width of the annular inner wall provided between the pair of the flexible membranes 64 is, for example, 10 mm. The flexible membrane 64 has a circular shape having a thickness of 1 mm and a diameter of 35 mm. At a central portion of the circular flexible membrane 64, a protruding portion 65 protruding in a thickness direction by approximately 2 mm is provided. Since the protruding portion 65 is provided at the center of the flexible membrane 64, the flow of the liquid around the protruding portion 65 is generated. Accordingly, the effect of stirring the liquid in the upstream damper chamber 61 can be further enhanced, and the precipitation of the liquid component can be further suppressed.

The flexible membranes 64 each have a rubber elasticity. The rubber elasticity indicates a specific elasticity by thermal motion of chain molecules of a rubber (elastomer) or the like, and in this embodiment, "having a rubber elasticity" indicates a property in which when a low pressure is applied, the amount of change in volume is small, and when a high pressure is applied, the amount of change in volume is large.

In the supply of the liquid by the diaphragm pump 40, a high pressure can be easily applied to the liquid supply path 32 as compared to that to the liquid discharge path 33, and the variation of the pressure in the liquid is also large. Since the flexible membranes 64 forming the upstream damper chamber 61 each have a rubber elasticity, when the liquid flows at a relatively high pressure, the amount of change in volume of the flexible membrane 64 increases, and when the liquid flows at a relatively low pressure, the amount of change in volume of the flexible membrane 64 decreases. By the deformation of the flexible membrane 64, since the volume of the upstream damper chamber 61 is changed, the upstream damper portion 60 can suppress the variation at a relatively high pressure. In addition, the volume of the upstream damper chamber 61 is configured to be smaller than the volume of the upstream filter chamber 53.

A material used for the flexible membrane 64, for example, there may be mentioned a butyl rubber, a silicone rubber, an ethylene-propylene-diene rubber (hereinafter, referred to as "EPDM"), an olefinic elastomer, or a fluorine-based rubber. Even when a liquid having a high attacking property to a flow path material is used, the flexible membrane 64 composed of an EPDM can maintain appropriate swelling while suppressing the degradation thereof, and hence the function of the flexible membrane 64 can be suppressed from being degraded. In addition, when the flexible membrane 64 is composed of an EPDM, as the liquid, an UV ink is preferably used. Since the flexible membrane 64 composed of an EPDM appropriately absorbs a component of the UV ink to expand, the flexible membrane 64 is softened, and the variation of the pressure can be further suppressed thereby. In addition, in this embodiment, the "high attacking property" indicates, for example, that a force of dissolving, expanding, cracking, and/or surface-roughing the flow path material or the like is high.

Next, the collective flow path member 70 and the downstream damper portion 75 will be described in more detail.

The liquid supplied from the upstream damper portion 60 through the liquid supply path 32 is fed to a collective flow path 71 provided in the collective flow path member 70.

The collective flow path member 70 is located at an upper side of the liquid ejection portions 80 and is a rectangular parallelepiped member extending along a liquid flow direction. The extending direction of the collective flow path member 70 is a longitudinal direction, and a direction intersecting the extending direction of the collective flow path member 70 is a lateral direction.

In the collective flow path member 70, there are provided grooves each functioning as a part of the collective flow path 71 and extending along the longitudinal direction, a plurality of inlet ports 72 communicating with the liquid ejection portions 80, and a plurality of outlet ports 73 communicating with the liquid ejection portions 80. In the collective flow path member 70, from the surface in which the grooves are provided to the surface opposite thereto, holes penetrating the collective flow path member 70 may be provided. The width of the groove and the length of the hole of the collective flow path member 70 in the lateral direction are each preferably 5 mm or more.

The collective flow path 71 includes a part of the liquid supply path 32 and a part of the liquid discharge path 33. The part of the liquid supply path 32 included in the collective flow path 71 communicates with the liquid ejection portions 80 through the inlet ports 72 opened in the bottom surface of the collective flow path member 70. The part of the liquid discharge path 33 included in the collective flow path 71 communicates with the subtank 30 through the outlet ports 73 opened in the bottom surface of the collective flow path member 70. The collective flow path 71 has a function to temporarily store the liquid.

The downstream damper portion 75 is disposed at a part of the collective flow path 71. The downstream damper portion 75 forms at least one of a part of the liquid supply path 32 and a part of the liquid discharge path 33. In this embodiment, an example in which the downstream damper portion 75 forms a part of the liquid discharge path 33 will be described.

The downstream damper portion 75 includes a flexible wall 76. The flexible wall 76 is composed of a resin film. The flexible wall 76 is deformed in association with the variation of the pressure in the liquid. Although being composed of a resin film having no rubber elasticity, the flexible wall 76 is deformed by a reduced pressure lower than the atmospheric pressure, and by the deformation of the flexible wall 76, the variation of the pressure in the liquid is suppressed.

The flexible wall 76 is thermally bonded to the collective flow path member 70 so as to seal the grooves and the holes formed in the collective flow path member 70. A space in the collective flow path member 70 defined by the flexible wall 76 and the groove forms a part of the collective flow path 71. In the thermal bonding of the flexible wall 76, the flexible wall 76 in a deformed state is bonded to the collective flow path member 70.

In the flexible wall 76, an inner layer of the flexible wall 76 to be in contact with the liquid is preferably composed of a polyolefin-based material, and an outer layer is preferably composed of a polyamide or a poly(ethylene terephthalate). As the polyolefin-based material, for example, a polyethylene or a polypropylene may be mentioned. When the collective flow path member 70 is composed of a polypropylene, as the flexible wall 76, there may be used a resin film in which a polypropylene having a thickness of 25 μm as the inner layer is thermally bonded to a poly(ethylene terephthalate) having a thickness of 12 μm as the outer layer. When the flexible wall 76 is composed of a polyolefin material as the inner layer and a poly(ethylene terephthalate) as the outer layer, while the flexibility is maintained, a flexible wall 76 having an appropriate gas barrier property can be obtained.

In the circulation path 31, the liquid discharge path 33 is apart from the diaphragm pump 40, and the pressure of the liquid flowing in the liquid discharge path 33 is low as compared to that flowing in the liquid supply path 32. When the downstream damper portion 75 is a part of the liquid discharge path 33, compared to the case in which the downstream damper portion 75 is a part of the liquid supply path 32, the pressure applied to the downstream damper portion 75, that is, the pressure applied to the flexible wall 76, is lower. Hence, the deformed state of the flexible wall 76 is likely to be maintained, and the variation of the pressure in the liquid can be further suppressed by the downstream damper portion 75.

Figure 7:
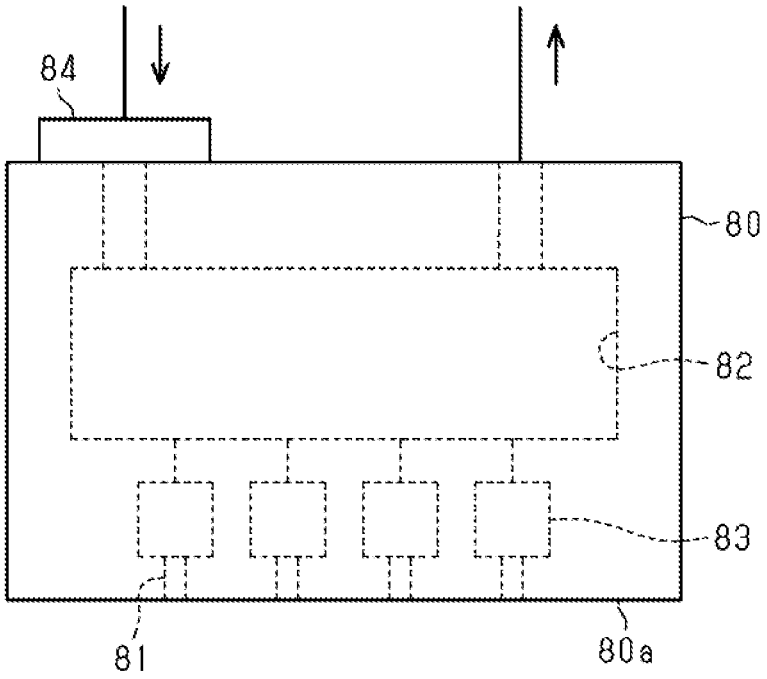
FIG. 7 is a cross-sectional view of a liquid ejection portion of the liquid ejecting apparatus shown in FIG. 1.

With reference to FIG. 7, the liquid ejection portion of the liquid ejecting apparatus will be described in more detail.

As shown in FIG. 7, the liquid ejection portion 80 includes the nozzles 81 capable of ejecting the liquid and a common liquid chamber 82 to supply the liquid supplied from the subtank 30 through the liquid supply path 32 to the nozzles 81.

The common liquid chamber 82 is coupled to the liquid supply path 32 and the liquid discharge path 33. The liquid supplied from the liquid supply path 32 of the collective flow path 71 through the inlet port 72 is fed to the common liquid chamber 82.

As a mechanism to eject the liquid from the nozzle 81, for example, an actuator including a piezoelectric element which is contracted by electrical application may be used. In this case, by the contraction of the piezoelectric element, the volume of a liquid chamber 83 provided between the common liquid chamber 82 and the nozzle 81 is changed, so that the liquid is ejected from the nozzle 81.

The liquid ejection portion 80 may include a head filter 84 which is located upstream than the nozzles 81 and which filtrates the liquid. Accordingly, the foreign materials, such as air bubbles, contained in the liquid are suppressed from flowing toward the nozzles 81. In addition, in the liquid supply path 32, the filter portion 50 described above is provided upstream than the head filter 84. Accordingly, since the liquid which is filtrated by the filter portion 50 and which contains a small amount of the foreign materials flows into the head filter 84, clogging thereof is suppressed, and the head filter 84 may be used for a long time.

The number of the liquid ejection portions 80 and the number of the nozzles 81 may be arbitrarily changed. When a plurality of the liquid ejection portions 80 is provided, a downstream side of the liquid supply path 32 communicating with the common liquid chamber 82 and an upstream side of the liquid discharge path 33 are each branched in accordance with the number of the common liquid chambers 82.

Next, the liquid used for the liquid ejecting apparatus will be described in more detail.

Ink Composition

An ink composition used in this embodiment contains a hindered amine compound and, if needed, may also contain the following components. In the above liquid ejecting apparatus 10, the ink composition is supplied to the liquid ejection portion 80 through the liquid supply path 32 and is then ejected from the liquid ejection portion 80.

Hindered Amine Compound

The ink composition used in this embodiment contains a hindered amine compound. In general, as a dissolved oxygen amount in the ink composition is smaller, an effect of suppressing polymerization of the ink by oxygen (dark reaction) is not likely to obtain. In addition, a polymerization inhibitor, such as p-methoxyphenol (MEHQ), will not function as a polymerization inhibitor when the dissolved oxygen amount is small. Hence, the ink composition is liable to be firmly adhered in a pump. However, since a hindered amine compound functions as a polymerization inhibitor even if the oxygen amount is small, although the dissolved oxygen amount is small, the ink composition can be suppressed from being firmly adhered in the pump.

Although not particularly limited, as the hindered amine compound, for example, there may be mentioned a compound having a 2,2,6,6-tetramethylpiperidine-N-oxyl skeleton, a compound having a 2,2,6,6-tetramethylpiperidine skeleton, a compound having a 2,2,6,6-tetramethylpiperidine-N-alkyl skeleton, or a compound having a 2,2,6,6-tetramethylpiperidine-N-acyl skeleton. By using the hindered amine compound as described above, the durability of the liquid ejecting apparatus 10 can be further improved.

As a commercially available hindered amine compound, for example, there may be mentioned ADK STAB LA-7RD (2,2,6,6-tetramethyl-4-hydroxypiperidine-1-oxyl (trade name, manufactured by ADEKA Corporation); IRGASTAB UV 10 (4,4'-[1,10-dioxo-1,10-decanediyl]bis(oxy)]bis[2,2,6,6-tetramethyl]-1-piperidinyloxy) (CAS. 2516-92-9) or TINUVIN 123 (4-hydroxy-2,2,6,6-tetramethylpiperidine-N-oxyl) (trade name, manufactured by BASF); FA-711HM or FA-712HM (2,2,6,6-tetramethylpiperidinyl methacrylate (trade name, manufactured by Hitachi chemical Company, Ltd.); TINUVIN 111FDL, TINUVIN 144, TINUVIN 152, TINUVIN 292, TINUVIN 765, TINUVIN 770DF, TINUVIN 5100, SANOL LS-2626, CHIMASSORB 119FL, CHIMASSORB 2020 FDL, CHIMASSORB 944 FDL, or TINUVIN 622 LD (trade name, manufactured by BASF); LA-52, LA-57, LA-62, LA-63P, LA-68LD, LA-77Y, LA-77G, LA-81, or LA-82 (1,2,2,6,6-pentamethyl-4-piperidyl methacrylate), or LA-87 (trade name, manufactured by ADEKA Corporation).

In addition, among the above commercially available products, LA-82 is a compound having a 2,2,6,6-tetramethylpiperidine-N-methyl skeleton, and ADK STAB LA-7RD and IRGASTAB UV 10 are each a compound having a 2,2,6,6-tetramethylpiperidine-N-oxyl skeleton. Among those mentioned above, since the storage stability of the ink and the durability of the cured ink can be further improved while an excellent curing property is maintained, a compound having a 2,2,6,6-tetramethylpiperidine-N-oxyl skeleton is preferably used.

Although a particular example of the compound having a 2,2,6,6-tetramethylpiperidine-N-oxyl skeleton described above is not particularly limited, for example, there may be mentioned 2,2,6,6-tetramethyl-4-hydroxypiperidine-1-oxyl, 4,4'-[1,10-dioxo-1,10-decanediyl]bis(oxy)]bis[2,2,6,6-tetramethyl]-1-piperidinyloxy, 4-hydroxy-2,2,6,6-tetramethylpiperidine-N-oxyl, bis(1-oxyl-2,2,6,6-tetramethylpiperidine-4-yl)sebacate, or bis(2,2,6,6-tetramethyl-1-(octyloxy)-4-piperidinyl)sebacate.

The hindered amine compounds may be used alone, or at least two types thereof may be used in combination.

The content of the hindered amine compound is with respect to the total mass (100 percent by mass) of the ink composition, preferably 0.05 to 0.5 percent by mass, more preferably 0.05 to 0.4 percent by mass, further preferably 0.05 to 0.2 percent by mass, and particularly preferably 0.06 to 0.2 percent by mass. Since the content is 0.05 percent by mass or more, the ink composition is suppressed from being firmly adhered in the pump, and the durability is further improved. In addition, since the content is 0.5 percent by mass or less, the solubility is further improved.

Other Polymerization Inhibitors

The ink composition of this embodiment may further contain, as the polymerization inhibitor, at least one compound other than the hindered amine compound. Although the compounds other than the hindered amine compound are not particularly limited, for example, there may be mentioned p-methoxyphenol (hydroxy monomethyl ether: MEHQ), hydroquinone, cresol, t-butylcatechol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butylphenol).

The compounds other than the hindered amine compound may be used alone, or at least two types thereof may be used in combination. The content of at least one of the compounds other than the hindered amine compound is determined by the relationship with the contents of the other components and is not particularly limited.

Photopolymerization Initiator

The ink composition of this embodiment may contain a photopolymerization initiator. The photopolymerization initiator is used to perform printing by curing an ink present on a surface of a recording medium by photopolymerization through radiation of ultraviolet rays. Since the liquid ejecting apparatus 10 according to this embodiment uses ultraviolet rays (UV) among radiation rays, the safety is excellent, and in addition, the cost of a light source can be reduced. As the photopolymerization initiator, as long as generating active species, such as radicals or cations, by energy of light (ultraviolet rays) and initiating polymerization of a polymerizable compound, any materials may be used, and a photo radical polymerization initiator or a photo cation polymerization initiator may be used. Among those mentioned above, a photo radical polymerization initiator is preferably used. When a photo radical polymerization initiator is used, in the case in which the oxygen amount is small, the polymerization is likely to proceed. Hence, in a pump in which oxygen is liable to be deficient, the viscosity of the ink composition tends to increase, and hence, the liquid ejecting apparatus 10 of this embodiment is particularly useful.

Although the photo radical polymerization initiator described above is not particularly limited, for example, there may be mentioned an aromatic ketone, an acylphosphine oxide compound, a thioxantone compound, an aromatic onium salt compound, an organic peroxide, a thio compound (such as a thiophenyl group-containing compound), an α-aminoalkylphenone compound, a hexaarylbiimidazole compound, a ketoxime ester compound, a borate compound, an azinium compound, a metallocene compound, an active ester compound, a compound having a carbon halogen bond, or an alkylamine compound.

Among those mentioned above, an acylphosphine oxide-based photopolymerization initiator (acylphosphine oxide compound) and a thioxantone-based photopolymerization initiator (thioxantone compound) are preferable, and an acylphosphine oxide-based photopolymerization initiator is more preferable. When an acylphosphine oxide-based photopolymerization initiator or a thioxanthone-based photopolymerization initiator, in particular, an acylphosphine oxide-based polymerization initiator, is used, a curing process by an UV-LED is further improved, and the curing property of the ink composition is further improved. In addition, when at least one of those photo radical polymerization initiators is used, since the viscosity of the ink composition tends to further increase in the pump, and the ejection stability is liable to degrade when the dissolved oxygen amount is large, the dissolved oxygen amount in the ink is required to be decreased, and the durability is disadvantageously degraded; hence, the liquid ejecting apparatus 10 according to this embodiment is particularly useful.

Although the acylphosphine oxide-based polymerization initiator is not particularly limited, in particular, for example, there may be mentioned bis(2,4,6-trimethylbenzoyl)-phenylphosphine oxide, 2,4,6-trimethylbenzoyl-diphenyl-phosphine oxide, or bis-(2,6-dimethoxybenzoyl)-2,4,4-trimethylpentylphosphine oxide.

Although a commercially available acylphosphine oxide-based polymerization initiator is not particularly limited, for example, there may be mentioned IRGACURE 819 (bis(2,4,6-trimethylbenzoyl)-phenylphosphine oxide) or DAROCUR TPO (2,4,6-trimethylbenzoyl-diphenyl-phosphine oxide).

The content of the acylphosphine oxide-based polymerization initiator is with respect to the total mass (100 percent by mass) of the ink composition, preferably 2 to 15 percent by mass, more preferably 5 to 13 percent by mass, and further preferably 7 to 13 percent by mass. When the content is 2 percent by mass or more, the curing property of the ink tends to be further improved. In addition, when the content is 13 percent by mass or less, the ejection stability tends to be further improved.

In addition, although the thioxanthone-based photopolymerization initiator is not particularly limited, for example, at least one of thioxanthone, diethylthioxanthone, isopropylthioxanthone, and chlorothioxanthone is preferably used. In addition, Although not particularly limited, as diethylthioxanthone, isopropylthioxanthone, and chlorothioxanthone, 2,4-diethylthioxanthone, 2-isopropylthioxanthone, and 2-chlorothioxanthone are, respectively, preferable. According to an ink composition containing the thioxanthone-based photopolymerization initiator as described above, the curing property, the storage stability, and the ejection stability tend to be further improved. Among those mentioned above, a thioxanthone-based photopolymerization initiator containing diethylthioxanthone is preferable. Since diethylthioxanthone is contained, active species can be more efficiently converted therefrom by ultraviolet rays (UV light) having a wide range.

Although a commercially available thioxanthone-based photopolymerization initiator is not particularly limited, for example, there may be mentioned Speedcure DETX (2,4-diethylhthioxanthone) or Speedcure ITX (2-isopropylthioxanthone) (manufactured by Lambson); or KAYACURE DETX-S (2,4-diethylhthioxanthone) (manufactured by Nippon Kayaku Co., Ltd.).

The content of the thioxanthone-based photopolymerization initiator is with respect to the total mass (100 percent by mass) of the ink composition, preferably 0.5 to 4 percent by mass and more preferably 1 to 4 percent by mass. When the content is 0.5 percent by mass or more, the curing property of the ink tends to be further improved. In addition, when the content is 4 percent by mass or less, the ejection stability is further improved.

Although other photo radical polymerization initiators are not particularly limited, for example, there may be mentioned acetophenone, acetophenone benzyl ketal, 1-hydroxycyclohexyl phenyl ketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropane-1-one, 2-hydroxy-2-methyl-1-phenylpropane-1-one, and 2-methyl-1-[4-methylthiophenyl]-2-morpholino-propane-1-one.

Although a commercially available photo radical polymerization initiator is not particularly limited, for example, there may be mentioned IRGACURE 651 (2,2-dimethoxy-1,2-diphenylethane-1-one), IRGACURE 184 (1-hydroxycyclohexyl-phenyl-ketone), DAROCUR 1173 (2-hydroxy-2-methyl-1-phenyl-propane-1-one), IRGACURE 2959 (1-[4-(2-hydroxyethoxy)-phenyl]-2-hydroxy-2-methyl-1-propane-1-one), IRGACURE 127 (2-hydroxy-1-{4-[4-(2-hydroxy-2-methyl-propyonyl)-benzyl]phenyl}-2-methyl-propane-1-one), IRGACURE 907 (2-methyl-1-(4-methylthiophenyl)-2-morpholinopropane-1-one), IRGACURE 369 (2-benzyl-2-dimethylamino-1-(4-morpholinophenyl)-butanone-1), IRGACURE 379 (2-(dimethylamino)-2-[4-methylphenyl]methyl)-1-[4-(4-morpholinyl) phenyl]-1-butanone), IRGACURE 784 (bis(η5-2,4-cyclopentadiene-1-yl)-bis(2,6-difluoro-3-(1H-pyrrol-1-yl)-phenyl)titanium), IRGACURE OXE 01 (1,2-octanedione, 1-[4-(phenylthio)-, 2-(o-benzoyloxime)]), IRGACURE OXE 02 (ethanone, 1-[9-ethyl-6-(2-methylzenzoyl)-9H-carbazole-3-yl]-, 1-(o-acetyloxime)), or IRGACURE 754 (blend of oxy-phenyl-acetic acid 2-[2-oxo-2-phenyl-acetoxy-ethoxy]-ethyl ester and oxy-phenyl-acetic acid 2-[2-hydroxy-ethoxy]-ethyl ester) (manufactured by BASF); Speedcure TPO (manufactured by Lambson); Lucirin TPO, LR8893, or LR8970 (manufactured by BASF); or Ubecryl P36 (manufactured by UCB).

Although the cationic polymerization initiator is not particularly limited, for example, a sulfonium salt or an iodonium salt may be mentioned. Although a commercially available cationic polymerization initiator is not particularly limited, for example, IRGACURE 250 or IRGACURE 270 may be mentioned.

The photopolymerization initiators may be used alone, or at least two types thereof may be used in combination.

The content of at least one of other photopolymerization initiators is preferably 5 to 20 percent by mass with respect to the total mass (100 percent by mass) of the ink composition. When the content is in the range described above, a sufficient ultraviolet ray curing rate can be obtained, and coloration caused by the photopolymerization initiator itself and/or undissolved residues thereof can be avoided.

Polymerizable Compound

The ink composition may contain a polymerizable compound. The polymerizable compound is polymerized by itself or by a function of the photopolymerization initiator in light radiation to cure a printed ink composition. Although the polymerizable compound is not particularly limited, for example, known monofunctional, bifunctional, and at least trifunctional monomers and oligomers may be used. The polymerizable compounds may be used alone, or at least two types thereof may be used in combination. Hereinafter, the polymerizable compounds will be described by way of example.

Although the monofunctional, the bifunctional, and the at least trifunctional monomers are not particularly limited, for example, there may be mentioned unsaturated carboxylic acids, such as (meth)acrylic acid, itaconic acid, crotonic acid, isocrotonic acid, and maleic acid; a salt, an ester, an urethane, an amide, and an anhydride of the unsaturated carboxylic acid; acrylonitrile, styrene, and various unsaturated polyesters, unsaturated polyethers, unsaturated polyamides, and unsaturated urethanes. In addition, as the monofunctional, the bifunctional, and the at least trifunctional oligomers, for example, there may be mentioned oligomers, such as a linear acryl oligomer, composed of the monomers mentioned above, epoxy (meth)acrylates, oxetane (meth) acrylates, aliphatic urethane (meth)acrylates, aromatic urethane (meth)acrylates, and polyester (meth)acrylates.

In addition, as other monofunctional monomers or polyfunctional monomers, a monomer containing a N-vinyl compound may also be used. Although the N-vinyl compound is not particularly limited, for example, there may be mentioned N-vinylformamide, N-vinylcarbazole, N-vinylacetamide, N-vinylpyrrolidone, N-vinylcaprolactam, acryloylmorpholine, and derivatives thereof.

Among the polymerizable compounds, an ester of (meth) acrylic acid, that is, (meth)acrylate, is preferable.

Although the monofunctional (meth)acrylate is not particularly limited, for example, there may be mentioned isoamyl (meth)acrylate, stearyl (meth)acrylate, lauryl (meth) acrylate, octyl (meth)acrylate, decyl (meth)acrylate, isomyristyl (meth)acrylate, isostearyl (meth)acrylate, 2-ethylhexyl-diglycol (meth)acrylate, 2-hydroxybutyl (meth)

acrylate, butoxyethyl (meth)acrylate, ethoxydiethylene glycol (meth)acrylate, methoxydiethylene glycol (meth) acrylate, methoxypolyethylene glycol (meth)acrylate, methoxypropylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 2-hydroxy-3-phenoxypropyl (meth) acrylate, lactone-modified flexible (meth)acrylate, t-butylcyclohexyl (meth)acrylate, dicyclopentanyl (meth)acrylate, or dicyclopentenyloxyethyl (meth)acrylate. Among those mentioned above, phenoxyethyl (meth)acrylate is preferable.

The content of the monofunctional (meth)acrylate is with respect to the total mass (100 percent by mass) of the ink composition, preferably 30 to 85 percent by mass and more preferably 40 to 75 percent by mass. When the content is set in the range described above, the curing property, the initiator solubility, the storage stability, and the ejection stability tend to be further improved.

As the monofunctional (meth)acrylate, a compound having a vinyl ether group may also be mentioned. Although the monofunctional (meth)acrylate as described above is not particularly limited, for example, there may be mentioned 2-vinyloxyethyl (meth)acrylate, 3-vinyloxypropyl (meth) acrylate, 1-methyl-2-vinyloxyethyl (meth)acrylate, 2-vinyloxypropyl (meth)acrylate, 4-vinyloxybutyl (meth)acrylate, 1-methyl-3-vinyloxypropyl (meth)acrylate, 1-vinyloxymethylpropyl (meth)acrylate, 2-methyl-3-vinyloxypropyl (meth)acrylate, 1,1-dimethyl-2-vinyloxyethyl (meth)acrylate, 3-vinyloxybutyl (meth)acrylate, 1-methyl-2-vinyloxypropyl (meth)acrylate, 2-vinyloxybutyl (meth)acrylate, 4-vinyloxycyclohexyl (meth)acrylate, 6-vinyloxyhexyl (meth) acrylate, 4-vinyloxymethylcyclohexylmethyl (meth) acrylate, 3-vinyloxymethylcyclohexylmethyl (meth) acrylate, 2-vinyloxymethylcyclohexylmethyl (meth) acrylate, p-vinyloxymethylphenylmethyl (meth)acrylate, m-vinyloxymethylphenylmethyl (meth)acrylate, o-vinyloxymethylphenylmethyl (meth)acrylate, 2-(vinyloxyethoxy)ethyl (meth)acrylate, 2-(vinyloxyisopropoxy)ethyl (meth)acrylate, 2-(vinyloxyethoxy) propyl (meth)acrylate, 2-(vinyloxyethoxy) isopropyl (meth)acrylate, 2-(vinyloxyisopropoxy) propyl (meth)acrylate, 2-(vinyloxyisopropoxy) isopropyl (meth)acrylate, 2-(vinyloxyethoxyethoxy)ethyl (meth)acrylate, 2-(vinyloxyethoxyisopropoxy)ethyl (meth) acrylate, 2-(vinyloxyisopropoxyethoxy)ethyl (meth)acrylate, 2-(vinyloxyisopropoxyisopropoxy)ethyl (meth)acrylate, 2-(vinyloxyethoxyethoxy) propyl (meth)acrylate, 2-(vinyloxyethoxyisopropoxy) propyl (meth)acrylate, 2 (vinyloxyisopropoxyethoxy)propyl (meth)acrylate, 2-(vinyloxyisopropoxyisopropoxy)propyl (meth)acrylate, 2-(vinyloxyethoxyethoxy) isopropyl (meth)acrylate, 2-(vinyloxyethoxyisopropoxy)isopropyl (meth)acrylate, 2-(vinyloxyisopropoxyethoxy)isopropyl (meth)acrylate, 2-(vinyloxyisopropoxyisopropoxy)isopropyl (meth)acrylate, 2-(vinyloxyethoxyethoxyethoxy)ethyl (meth)acrylate, 2-(vinyloxyethoxyethoxyethoxyethoxy)ethyl (meth)acrylate, 2-(isopropenoxyethoxy)ethyl (meth)acrylate, 2-(isopropenoxyethoxyethoxy)ethyl (meth)acrylate, 2-(isopropenoxyethoxyethoxyethoxy)ethyl (meth)acrylate, 2-(isopropenoxyethoxyethoxyethoxyethoxy)ethyl (meth) acrylate, polyethylene glycol monovinyl ether (meth)acrylate, polypropylene glycol monovinyl ether (meth)acrylate, phenoxyethyl (meth)acrylate, isobornyl (meth)acrylate, or benzyl (meth)acrylate. Among those mentioned above, 2-(vinyloxyethoxy)ethyl (meth)acrylate, phenoxyethyl (meth)acrylate, isobornyl (meth)acrylate, or benzyl (meth) acrylate is preferable.

Among those mentioned above, since the viscosity of the ink can be further decreased, the flash point is high, and the curing property of the ink is excellent, 2-(vinyloxyethoxy) ethyl (meth)acrylate, that is, at least one of 2-(vinyloxyethoxy)ethyl acrylate and 2-(vinyloxyethoxy)ethyl methacrylate, is preferable, and 2-(vinyloxyethoxy)ethyl acrylate is more preferable. Since 2-(vinyloxyethoxy)ethyl acrylate and 2-(vinyloxyethoxy)ethyl methacrylate each have a simple structure and a small molecular weight, the viscosity of the ink can be significantly decreased. As 2-(vinyloxyethoxy)ethyl methacrylate, 2-(2-vinyloxyethoxy)ethyl methacrylate or 2-(1-vinyloxyethoxy)ethyl methacrylate may be mentioned, and as 2-(vinyloxyethoxy)ethyl acrylate, 2-(2-vinyloxyethoxy)ethyl acrylate or 2-(1-vinyloxyethoxy) ethyl acrylate may be mentioned. In addition, 2-(vinyloxyethoxy)ethyl acrylate is superior to 2-(vinyloxyethoxy)ethyl methacrylate in terms of the curing property.

The content of the vinyl ether group-containing (meth) acrylate ester, in particular, the content of 2-(vinyloxyethoxy)ethyl (meth)acrylate, is with respect to the total mass (100 percent by mass) of the ink composition, preferably 10 to 70 percent by mass and more preferably 30 to 50 percent by mass. When the content is 10 percent by mass or more, the viscosity of the ink can be decreased, and in addition, the curing property of the ink can be further improved. On the other hand, when the content is 70 percent by mass or less, the storage stability of the ink can be maintained in a preferable level.

Among the (meth)acrylates described above, as the bifunctional (meth)acrylate, for example, there may be mentioned triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth) acrylate, 1,9-nonanediol di(meth)acrylate, neopentyl glycol di(meth)acrylate, dimethylol-tricyclodecane di(meth)acrylate, bisphenol A EO (ethylene oxide) adduct di(meth) acrylate, bisphenol A PO (propylene oxide) adduct di(meth) acrylate, hydroxypivalic acid neopentyl glycol di(meth) acrylate, polytetramethylene glycol di(meth)acrylate, diethylene glycol di(meth)acrylate, triethylene glycol di(meth)acrylate, or an at least trifunctional (meth)acrylate having a pentaerythritol skeleton or a dipentaerythritol skeleton. In particular, dipropylene glycol di(meth)acrylate, tripropylene glycol di(meth)acrylate, diethylene glycol di(meth)acrylate, triethylene glycol di(meth)acrylate, or an at least trifunctional (meth)acrylate having a pentaerythritol skeleton or a dipentaerythritol skeleton is preferable. Among those mentioned above, dipropylene glycol di(meth)acrylate is more preferable. The ink composition more preferably contains, besides a monofunctional (meth)acrylate, a polyfunctional (meth)acrylate.

The content of an at least bifunctional (meth)acrylate is with respect to the total mass (100 percent by mass), preferably 5 to 60 percent by mass, more preferably 15 to 60 percent by mass, and further preferably 20 to 50 percent by mass. When the content is set in the range described above, the curing property, the storage stability, and the ejection stability tend to be further improved.

Among the (meth)acrylates mentioned above, as the at least trifunctional (meth)acrylate, for example, there may be mentioned trimethylolpropane tri(meth)acrylate, EO-modified trimethylolpropane tri(meth)acrylate, pentaerythritol tri (meth)acrylate, pentaerythritol tetra(meth)acrylate, dipentaerythritol hexa(meth)acrylate, ditrimethylolpropane tetra (meth)acrylate, glycerin propoxy tri(meth)acrylate, caprolactone-modified trimethylolpropane tri(meth)acrylate, pentaerythritol ethoxy tetra(meth)acrylate, or caprolactam-modified dipentaerythritol hexa(meth)acrylate. When the ink contains an at least trifunctional (meth) acrylate, the curing property of the ink is preferably improved, and the content thereof is with respect to the total mass (100 percent by mass) of the ink composition, preferably 5 to 40 percent by mass, more preferably 5 to 30 percent by mass, and further preferably 5 to 20 percent by mass. Although the upper limit of the number of (meth)acrylate functions is not particularly limited, since the viscosity of the ink can be decreased, the number of functions is preferably six or less.

Among those mentioned above, the polymerizable compound preferably contains a monofunctional (meth)acrylate. In the case described above, the viscosity of the ink composition is decreased, the solubility of the photopolymerization initiator and the other additives is improved, and the ejection stability in ink jet recording can be easily obtained. Furthermore, since the toughness, the heat resistance, and the chemical resistance of the coating film are improved, a monofunctional (meth)acrylate and a bifunctional (meth) acrylate are more preferably used in combination, and in particular, phenoxyethyl (meth)acrylate and dipropylene glycol (meth)acrylate are more preferably used in combination.

The content of the polymerizable compound is with respect to the total mass (100 percent by mass) of the ink composition, preferably 5 to 95 percent by mass and more preferably 15 to 90 percent by mass. When the content of the polymerizable compound is set in the range described above, the viscosity and the odor can both be decreased, and in addition, the solubility and the reactivity of the photopolymerization initiator can be further improved.

Coloring Material

The ink composition may further contain a coloring material. As the coloring material, at least one of a dye and a pigment may be used.

Pigment

When a pigment is used as the coloring material, the light resistance of the ink composition can be improved. As the pigment, an inorganic pigment and/or an organic pigment may be used.

As the inorganic pigment, for example, carbon black (C.I. Pigment Black 7), such as furnace black, lamp black, acetylene black, or channel black; an iron oxide, or a titanium oxide may be used.

As the organic pigment, for example, there may be mentioned an azo pigment, such as an insoluble azo pigment, a condensed azo pigment, an azo lake, or a chelate azo pigment; a polycyclic pigment, such as a phthalocyanine pigment, a perylene pigment, a perinone pigment, an anthraquinone pigment, a quinacridone pigment, a dioxane pigment, a thioindigo pigment, an isoindolinone pigment, or a quinophthalone pigment; a dye chelate, such as a basic dye type chelate or an acid dye type chelate; a dye lake, such as a basic dye type lake or an acid dye type lake; a nitro pigment, a nitroso pigment, an aniline black, or a daylight fluorescent pigment.

In more detail, as the carbon black used for a black ink, for example, there may be mentioned No. 2300, No. 900, MCF88, No. 33, No. 40, No. 45, No. 52, MA7, MA8, MA100, or No. 2200B (manufactured by Mitsubishi Chemical Corporation); Raven 5750, Raven 5250, Raven 5000, Raven 3500, Raven 1255, or Raven 700 (manufactured by Carbon Columbia); Regal 400R, Regal 330R, Regal 660R, Mogul L, Monarch 700, Monarch 800, Monarch 880, Monarch 900, Monarch 1000, Monarch 1100, Monarch 1300, or Monarch 1400 (manufactured by CABOT JAPAN K.K.); or Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, or Special Black 4 (manufactured by Degussa).

As a pigment used for a white ink, for example, C.I. Pigment White 6, 18, or 21 may be mentioned.

As a pigment used for a yellow ink, for example, there may be mentioned C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, or 180.

As a pigment used for a magenta ink, for example, there may be mentioned C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, or 245, or C.I. Pigment Violet 19, 23, 32, 33, 36, 38, 43, or 50.

As a pigment used for a cyan ink, for example, there may be mentioned C.I. Pigment Blue 1, 2, 3, 15, 15:1, 15:2, 15:3, 15:34, 15:4, 16, 18, 22, 25, 60, 65, or 66, or C.I. Vat Blue 4 or 60.

In addition, as a pigment other than magenta, cyan, and yellow, for example, there may be mentioned C.I. Pigment Green 7 or 10, C.I. Pigment Brown 3, 5, 25, or 26, or C.I. Pigment Orange 1, 2, 5, 7, 13, 14, 15, 16, 24, 34, 36, 38, 40, 43, or 63.

The pigments mentioned above may be used alone, or at least two types thereof may be used in combination.

When the pigments mentioned above are used, the average particle diameter of the pigment is preferably 300 nm or less and more preferably 50 to 200 nm. When the average particle diameter is in the range described above, the reliability, such as the ejection stability and the dispersion stability, of the ink composition are further enhanced, and in addition, an image having an excellent image quality can be formed. In this specification, the average particle diameter can be measured by a dynamic light scattering method.

Dye

As the coloring material, a dye may be used. The dye is not particularly limited, and for example, an acidic dye, a direct dye, a reactive dye, or a basic dye may be used. As the dye mentioned above, for example, there may be mentioned C.I. Acid Yellow 17, 23, 42, 44, 79, or 142, C.I. Acid Red 52, 80, 82, 249, 254, or 289, C.I. Acid Blue 9, 45, or 249, C.I. Acid Black 1, 2, 24, or 94, C.I. Food Black 1 or 2, C.I. Direct Yellow 1, 12, 24, 33, 50, 55, 58, 86, 132, 142, 144, or 173, C.I. Direct Red 1, 4, 9, 80, 81, 225, or 227, C.I. Direct Blue 1, 2, 15, 71, 86, 87, 98, 165, 199, or 202, C.I. Direct Black 19, 38, 51, 71, 154, 168, 171, or 195, C.I. Reactive Red 14, 32, 55, 79, or 249, or C.I. Reactive black 3, 4, or 35.

The dyes mentioned above may be used alone, or at least two types thereof may be used in combination.

Since excellent shielding property and color reproducibility are obtained, the content of the coloring material is preferably 1 to 20 percent by mass with respect to the total mass (100 percent by mass) of the ink composition.

Dispersant

When the ink composition contains a pigment, in order to obtain a more preferable pigment dispersibility, a dispersant may be further contained. Although the dispersant is not particularly limited, for example, a dispersant, such as a high molecular weight dispersant, which has been generally used to prepare a pigment dispersion liquid may be mentioned. As a particular example, there may be mentioned a dispersant containing as a primary component at least one selected from a polyoxyalkylene polyalkylene polyamine, a vinyl-based polymer and its copolymer, an acrylic-based polymer and its copolymer, a polyester, a polyamide, a polyimide, a polyurethane, an amino-based polymer, a silicon-containing polymer, a sulfur-containing polymer, a fluorine-containing polymer, and an epoxy resin. As a commercially available high molecular weight dispersant, for example, there may be mentioned Ajisper Series manufactured by Ajinomoto Fine-Techno Co., Inc., Solsperse Series (such as Solsperse 36000) available from Avecia or Noveon, Disperse Bic Series manufactured by BYK Chemie, or Disparlon Series manufactured by Kusumoto Chemicals, Ltd.

Other Additives

The ink composition may contain other additives (components) other than the additives mentioned above. Although the components mentioned above are not particularly limited, for example, known additives, such as a slipping agent (surfactant), a polymerization promoter, a permeation promoter, and a wetting agent (moisturizing agent), and other additives may also be used. As other additives mentioned above, for example, there may be mentioned known additives, such as a fixing agent, a fungicide, an antiseptic agent, an antioxidant, an UV absorber, a chelating agent, a pH adjuster, and a thickening agent.

The effects and the advantages of the above structure will be described.

(1) In the liquid supply path 32 to which the liquid is supplied from the diaphragm pump 40, compared to the liquid discharge path 33, the pressure of the liquid is high, and the variation of the pressure in the liquid is also large. Since the flexible membrane 64, which is a part of the wall forming the upstream damper chamber 61, has a rubber elasticity, the variation at a relatively high pressure can be suppressed by the upstream damper portion 60. On the other hand, since the downstream damper portion 75 has the flexible wall 76 composed of a resin film, the variation at a relatively low pressure can be suppressed by the downstream damper portion 75. Hence, in the liquid ejecting apparatus 10, the variation of the pressure in the liquid can be suppressed.

(2) In the upstream damper portion 60, the flow direction of the liquid at the inlet path 62 is different from that at the outlet path 63. Hence, for example, compared to the case in which the liquid flows linearly in the upstream damper chamber 61, the variation of the pressure in the liquid can be further suppressed.

(3) Since the outlet path 63 is opened at an upper side than the center of the upstream damper chamber 61 in the vertical direction, air bubbles in the upstream damper chamber 61 can be easily discharged. In addition, in the upstream damper chamber 61, the component of the liquid may precipitate in some cases. Since the inlet path 62 is opened at a lower side than the center of the upstream damper chamber 61 in the vertical direction, by the liquid flowing therein, the liquid in the upstream damper chamber 61 is stirred, and hence, the component of the liquid can be suppressed from precipitating.

(4) As the liquid, even when a liquid having a high attacking property to a flow path material is used, while the flexible membrane 64 is suppressed from degrading, appropriate swelling of the flexible membrane 64 can be maintained; hence, the degradation of the function of the flexible membrane 64 can be suppressed.

(5) When the flexible wall 76 is configured so that the inner layer is composed of a polyolefinic material, and the outer layer is composed of a polyamide or a poly(ethylene terephthalate), while the flexibility of the flexible wall 76 is maintained, the gas barrier property thereof can be appropriately adjusted.

(6) By the filter 52, the foreign materials, such as air bubbles, in the liquid can be collected. The volume of the air bubbles thus collected is changed in association with the variation of the pressure in the liquid, and the variation of the pressure in the liquid can be further suppressed.

(7) While the liquid in the circulation path 31 is circulated by the diaphragm pump 40, since the subtank 30 can maintain an appropriate pressure at the nozzle 81 of the liquid ejection portion 80, the liquid can be circulated in the state in which the gas-liquid interface is not destroyed. In addition, in the circulation path 31, compared to the liquid supply path 32, the liquid discharge path 33 is far from the diaphragm pump 40, the pressure of the liquid flowing therein is lower than that flowing in the liquid supply path 32. That is, when the downstream damper portion 75 forms a part of the liquid discharge path 33, compared to the case in which the downstream damper portion 75 forms a part of the liquid supply path 32, the pressure applied to the resin film of the downstream damper portion 75 is low. Hence, the resin film is likely to maintain a deformed state, and hence, the downstream damper portion 75 can further suppress the variation of the pressure in the liquid.

The above structure may be modified as described below. The structure described above and the following modified examples may be performed in combination as long as no technical contradiction occurs.

- The liquid ejecting apparatus 10 may be changed so that at least one of the heating portion 48 and the deaeration portion 49 is omitted.
- The position of the filter portion 50 may be changed to a position of the liquid supply path 32 between the deaeration portion 49 and the diaphragm pump 40.
- The filter portion 50 may be configured to allow air to stay in the upstream filter chamber 53 and to function as an air damper which suppresses the variation of the pressure in the liquid.
- In the structure including the deaeration portion 49, by the deaeration portion 49, the deaeration operation may be stopped or the level of the deaeration may be lowered so as to allow air to stay in the upstream filter chamber 53 of the filter portion 50 and to suppress the variation of the pressure in the liquid by the filter portion 50.
- As the pump, the diaphragm pump 40 may be changed, for example, to a tube pump, a gear pump, or a screw pump. In addition, the pump may be changed to a three-phase diaphragm pump 40.
- The upstream damper portion 60 may be changed to an accumulator. A bladder of the accumulator corresponds to the wall composed of the flexible membrane 64 having a rubber elasticity.
- The wall forming the part of the liquid supply path 32 communicating with the liquid ejection portions 80 may be partially composed of the flexible wall 76 composed of a resin film. In addition, when the downstream damper portion 75 forms a part of the liquid supply path 32, the pressure is higher than the atmospheric pressure. Hence, when the downstream damper portion 75 forms a part of the liquid discharge path 33, it is preferable since the variation of the pressure in the liquid can be further suppressed.

The circulation path 31 may include a pressure chamber communicating with the nozzle 81, the pressure chamber being a part of the inside of the liquid ejection portion 80.

Figure 8:
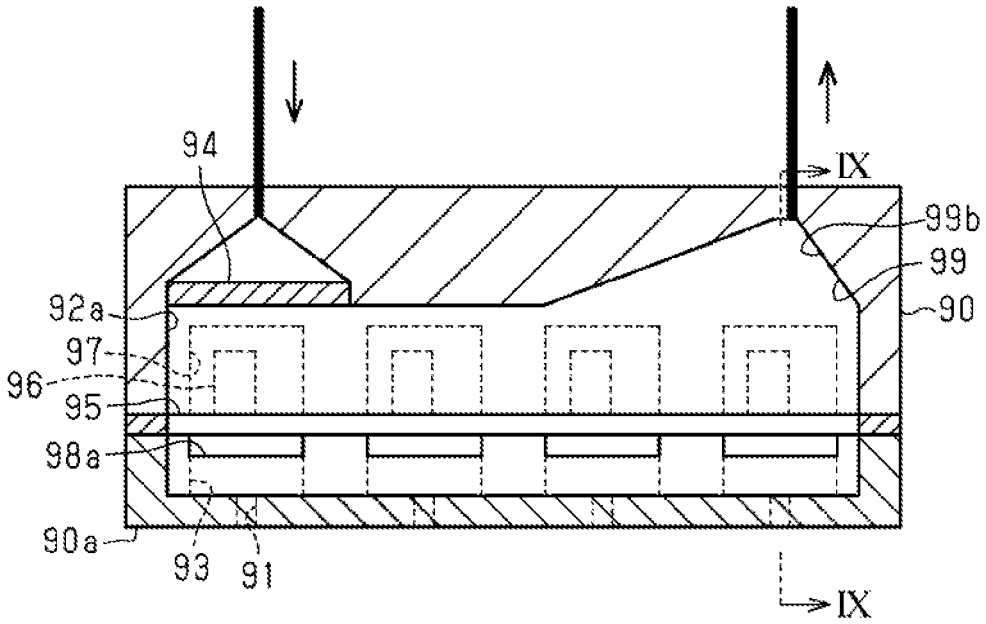
FIG. 8 is a cross-sectional view of a modified example of the liquid ejection portion of the liquid ejecting apparatus shown in FIG. 1.
Figure 9:
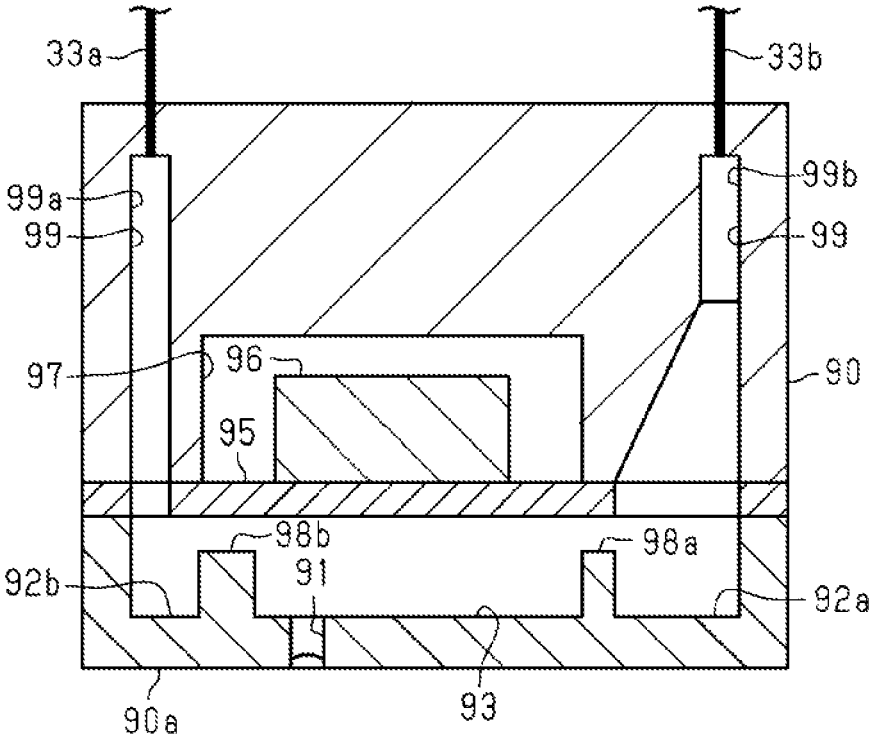
FIG. 9 is a cross-sectional view taken along the line IX-IX shown in FIG. 8.

With reference to FIGS. 8 and 9, the structure in which the pressure chamber communicating with the nozzle is included in the circulation path 31 will be described in more detail. In addition, a liquid ejection portion 90 shown in FIGS. 8 and 9 may be used instead of using the liquid ejection portion 80 shown in FIGS. 1 and 7. Hence, constituent elements other than the liquid ejection portion 80 shown in FIG. 1 are each designated by the same reference numeral, and duplicated description is omitted.

As shown in FIGS. 8 and 9, the liquid ejection portion 90 includes a plurality of nozzles 91 which eject the liquid, a nozzle surface 90*a* in which the plurality of nozzles 91 is formed, and a common liquid chamber 92*a* to which the liquid is supplied. To the common liquid chamber 92*a*, the liquid is supplied from the subtank 30 through the liquid supply path 32. The liquid supply path 32 is coupled to the common liquid chamber 92*a*. For the common liquid chamber 92*a*, a head filter 94 to trap the foreign materials, such as air bubbles, in the liquid to be supplied may be provided. The common liquid chamber 92*a* receives the liquid passing through the head filter 94.

The liquid ejection portion 90 includes a plurality of pressure chambers 93 communicating with the common liquid chamber 92*a*. The nozzles 91 are provided for the respective pressure chambers 93. The pressure chamber 93 communicates with the common liquid chamber 92*a* and the nozzle 91. A part of the wall surface of the pressure chamber 93 is composed of an oscillation plate 95. The common liquid chamber 92*a* and the pressure chamber 93 communicate with each other through a supply-side communication path 98*a*.

The liquid ejection portion 90 includes a plurality of actuators 96 provided for the respective pressure chambers 93. The actuator 96 is provided on a surface of the oscillation plate 95 opposite to that facing the pressure chamber 93. The actuator 96 is received in a receiving chamber 97 disposed at a position different from that of the common liquid chamber 92*a*. The liquid ejection portion 90 ejects the liquid in the pressure chamber 93 from the nozzle 91 by drive of the actuator 96. Since the liquid ejection portion 90 ejects the liquid from the nozzle 91 to a medium M, a recording treatment is performed on the medium M.

The actuator 96 of this embodiment is composed of a piezoelectric element to be contracted upon application of a drive voltage. After the oscillation plate 95 is deformed in association with the contraction of the actuator 96 upon application of the drive voltage, the application of the drive voltage to the actuator 96 is released, so that the liquid in the pressure chamber 93, the volume of which is changed, is ejected in the form of liquid from the nozzle 91.

The liquid ejection portion 90 has a discharge flow path 99 which discharges the liquid in the liquid ejection portion 90 to the outside without through the nozzle 91. The discharge flow path 99 includes a first discharge flow path 99*a* to be coupled to the pressure chamber 93 so as to discharge the liquid therein to the outside. The liquid flowing through the first discharge flow path 99*a* is discharged outside of the pressure chamber 93 without flowing from the pressure chamber 93 to the nozzle 91.

The liquid ejection portion 90 may include a discharge liquid chamber 92*b* communicating with the pressure chambers 93 and the first discharge flow path 99*a*. In this case, the first discharge flow path 99*a* communicates with the pressure chambers 93 through the discharge liquid chamber 92*b*. That is, the first discharge flow path 99*a* is indirectly coupled to the pressure chambers 93. The pressure chamber 93 and the discharge liquid chamber 92*b* communicate with each other through a discharge-side communication path 98*b*. Since the discharge liquid chamber 92*b* is provided, the first discharge flow path 99*a* may only be provided for the pressure chambers 93. That is, since the discharge liquid chamber 92*b* is provided, the first discharge flow path 99*a* is not required to be provided for each of the pressure chambers 93. Accordingly, the structure of the liquid ejection portion 90 can be simplified. The liquid ejection portion 90 may also have a plurality of first discharge flow paths 99*a* for the respective pressure chambers 93.

The liquid ejection portion 90 may include a second discharge flow path 99*b* coupled to the common liquid chamber 92*a* and the liquid discharge path 33 so as to discharge the liquid in the common liquid chamber 92*a* to the outside without through the pressure chamber 93. In this case, the discharge flow path 99 includes the first discharge flow path 99*a* and the second discharge flow path 99*b*. That is, the liquid ejection portion 90 includes the first discharge flow path 99*a* and the second discharge flow path 99*b*. The first discharge flow path 99*a* is a discharge flow path 99 coupled to the pressure chambers 93. The second discharge flow path 99*b* is a discharge flow path 99 coupled to the common liquid chamber 92*a*.

The liquid discharge path 33 may include a first liquid discharge path 33*a* coupled to the first discharge flow path 99*a* and a second liquid discharge path 33*b* coupled to the second discharge flow path 99*b*. The liquid discharge path 33 may be configured so that the first liquid discharge path 33*a* and the second liquid discharge path 33*b* are merged with each other or are each coupled to the liquid discharge path 33. When the first liquid discharge path 33*a* and the second liquid discharge path 33*b* are provided, a switching valve may be provided. The switching valve switches between the state in which the first liquid discharge path 33*a* communicates with the liquid discharge path 33 and the second liquid discharge path 33*b* is not allowed to communicate therewith and the state in which the first liquid discharge path 33*a* is not allowed to communicate with the liquid discharge path 33 and the second liquid discharge path 33*b* communicates therewith. The switch valve may be provided at a merge portion at which the first liquid discharge path 33*a* and the second liquid discharge path 33*b* are merged together or may be provided for each of the first liquid discharge path 33*a* and the second liquid discharge path 33*b*.

Maintenance Method

Next, a maintenance method of the above liquid ejecting apparatus 10 will be described.

In this embodiment, before the pressure cleaning of the nozzle 81 is performed, cleaning of the filter portion 50 will be performed.

When the liquid passes through the filter 52 in the filter portion 50, the foreign materials contained in the liquid are trapped by the filter 52. The foreign materials include air bubbles contained in the liquid, polymerized foreign materials generated due to friction by contact of the liquid with the pump or the like, and aggregates of unstably dispersed pigments contained in the liquid. When the liquid successively passes through the filter 52, the foreign materials are accumulated on the filter 52, thereby generating clogging of the filter 52. As a result, since a flow path resistance of the filter 52 is increased, the flow rate of the liquid to be supplied to the liquid ejection portion 80 is decreased. The phenomenon as described above causes problems, such as degradation of an image quality due to insufficient flow rate and an increase in waiting time required for temperature adjustment of the liquid ejection portion 80 due to a decrease of the temperature thereof.

Hence, as one maintenance method, the control portion 100 performs cleaning of the filter portion 50. In the cleaning of the filter portion 50, the discharge valve 59 is closed, and in the non-communication state between the filter portion 50 and the subtank 30, the diaphragm pump 40 is driven. In addition, in the state in which the liquid flows to the liquid ejection portion 80, the discharge valve 59 is opened so that the subtank 30 is in communication with the upstream filter chamber 53.

With reference to a flowchart shown in FIG. 10, the cleaning of the filter portion 50 will be described.

Figure 10:
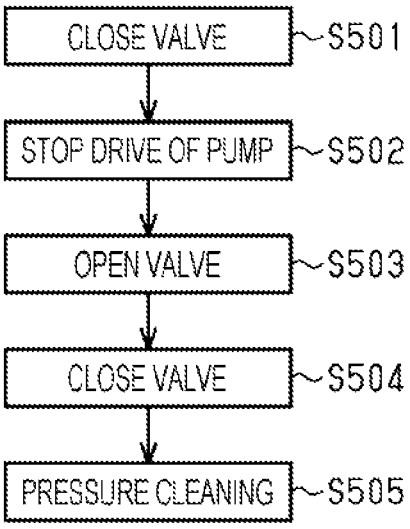
FIG. 10 is a flowchart showing a maintenance method of a liquid ejecting apparatus.

As shown in FIG. 10, in a step S501, the control portion 100 drives the diaphragm pump 40 to supply the liquid to the liquid ejection portion 80. In this step, the control portion 100 closes the discharge valve 59 provided for the deaeration path 58, so that the filter portion 50 is in non-communication with the subtank 30. Accordingly, by the drive of the diaphragm pump 40, the pressure of the liquid flowing in the filter portion 50 is increased.

In a step S502, the control portion 100 stops the drive of the diaphragm pump 40. When the drive of the diaphragm pump 40 is stopped, the pressure of the liquid in the upstream filter chamber 53 is maintained at a pressure at which the diaphragm pump 40 is driven.

In a step S503, since the control portion 100 opens the discharge valve 59 provided for the deaeration path 58 so that the filter portion 50 is in communication with the subtank 30, the pressure in the filter portion 50 is released. In this step, the pressure in the subtank 30 is adjusted to be lower than an outside pressure at the nozzle surface 80*a* and not to destroy the meniscus formed at the nozzle 81. Hence, since the control portion 100 opens the discharge valve 59, the pressure in the upstream filter chamber 53 in communication with the subtank 30 is reduced lower than the outside pressure. At this stage, the aggregated condition of the foreign materials trapped by the filter 52 is changed. In particular, a phenomenon in which the aggregates, such as unstably dispersed pigments, are loosened into fine particles is observed. Since the aggregates trapped by the filer 52 are loosened into fine particles, the foreign materials are likely to pass through the filter 52, and hence, the foreign materials can be removed from the filter 52. Accordingly, while air is suppressed from entering through the nozzle 81, the clogging of the filter 52 can be overcome.

Subsequently, in a step S504, the control portion 100 closes the discharge valve 59, so that the communication state between the subtank 30 and the upstream filter chamber 53 is again returned to the non-communication state.

In addition, in a step S505, the pressure cleaning is started. In the pressure cleaning, a pressure adjustment mechanism sets a pressure to be applied to the liquid in the subtank 30 so that the meniscus formed at the nozzle 81 is destroyed. As the pressure adjustment mechanism, for example, there may be mentioned the pressurizing module 36, the supply pump 23, and/or an air open valve. The liquid containing the foreign materials removed from the filter 52 is discharged from the nozzle 81 through the liquid supply path 32 by the pressure adjustment mechanism.

In addition, in the step S501, since the diaphragm pump 40 is driven while the discharge valve 59 is closed, in the upstream damper chamber 61 located between the downstream filter chamber 54 of the filter portion 50 and the liquid ejection portion 80, the pressure of the liquid is increased. As a result, the flexible membranes 64 each forming the wall of the upstream damper chamber 61 is deformed toward a gas chamber 66 side opposite to the inside of the upstream damper portion 60. In the state as described above, in the step S502, since the drive of the diaphragm pump 40 is stopped, the pressure of the liquid in the upstream damper chamber 61 is reduced lower than that during the drive of the diaphragm pump 40. As a result, the flexible membranes 64 each deformed to the gas chamber 66 side is returned to an upstream damper chamber 61 side.

In addition, in the step S503, since the discharge valve 59 is opened, the pressure in the upstream damper chamber 61 is further reduced. Accordingly, the flexible membranes 64 are each deformed further to the upstream damper chamber 61 side. The deformation of the flexible membranes 64 as described above promotes, in the upstream damper chamber 61, the flow back of the liquid to the filter portion 50 from the upstream damper chamber 61. In addition, the liquid flows back so that outside air is not allowed to enter through the nozzle 81. Accordingly, the liquid in the upstream damper chamber 61 flows in the downstream filter chamber 54 of the filter portion 50 and further flows toward the upstream filter chamber 53 through the filter 52. In this step, the foreign materials trapped on the filter 52 are likely to be removed from the filter 52 by the liquid flowing back in the upstream damper chamber 61.

As described above, by combination between the intermittent drive of the diaphragm pump 40 and the open and close of the discharge valve 59, the foreign materials trapped by the filter 52 can be removed therefrom.

The effects and the advantages of the structure described above will be described.

(8) Since the upstream filter chamber 53 pressurized by the diaphragm pump 40 communicates with the subtank 30 at a lower pressure than that in the upstream filter chamber 53, the pressure therein is reduced. Hence, for example, the aggregates trapped by the filter 52 are loosened into fine particles, so that the foreign materials, such as fine particles and air bubbles, are likely to pass through the filter 52. Accordingly, the foreign materials trapped by the filter 52 are likely to pass through the filter 52. In particular, since the foreign materials trapped by the filter 52 can be removed therefrom, while air is suppressed from entering through the nozzle 81, the clogging of the filter 52 can be suppressed.

(9) Compared to the case in which while the diaphragm pump 40 is driven, the non-communication state is switched to the communication state through the deaeration path 58, the pressure in the upstream filter chamber 53 is likely to be reduced, and in addition, the drive time of the diaphragm pump 40 can be decreased.

(10) By the pressure cleaning, the foreign materials, which are made to easily pass through the filter 52, are allowed to pass through the filter 52 and can be subsequently discharged through the nozzle 81 together with the foreign materials staying in the liquid ejection portion 80. As a result, since the foreign materials causing the clogging of the filer 52 can be discharged from the liquid path, the clogging of the filter 52 can be further suppressed.

(11) Of the liquid to be supplied to the liquid ejection portion 80, a liquid not to be discharged from the nozzle 81 is returned to the subtank 30, and hence, the consumption of the liquid can be reduced.

(12) By the pressure of the liquid in the liquid supply path 32, the flexible membrane 64 is deformed. The deformation of the flexible membrane 64 promotes the flow back of the liquid through the liquid supply path 32, and hence, the foreign materials on the filter 52 are likely to be removed.

The above structure may be modified as described below. The structure described above and the following modified examples may be performed in combination as long as no technical contradiction occurs.

Figure 11:
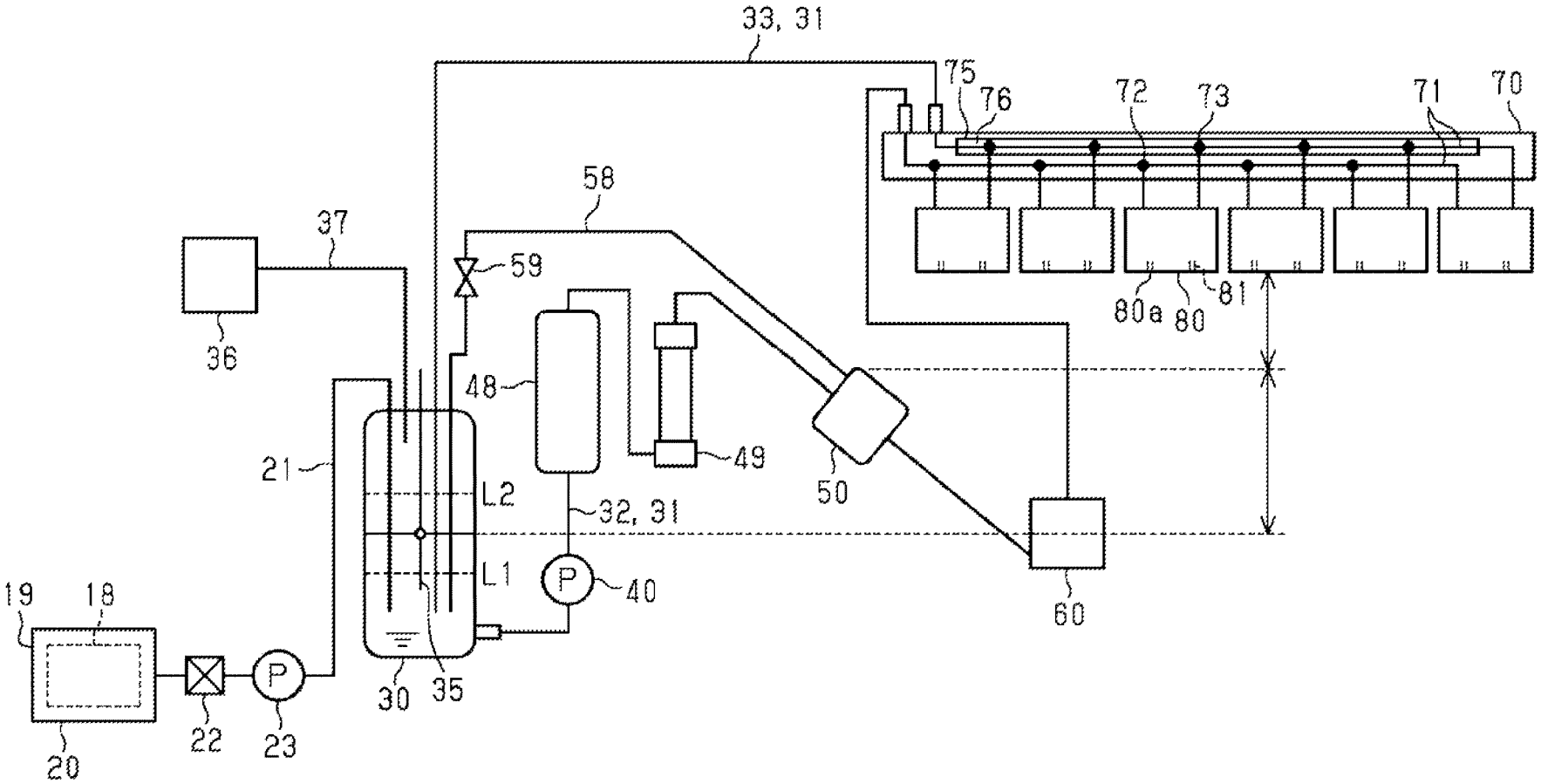
FIG. 11 is an entire structural view of a modified example of the liquid ejecting apparatus.

As shown in FIG. 11, the filter portion 50 may be located at an upper side with respect to the liquid level of the subtank 30 in the vertical direction, and the nozzle surface 80*a* may be located at an upper side with respect to the position of the filter 52 in the vertical direction. The point is that the structure may be formed so that the pressure applied to the liquid in the subtank 30 is lower than that in the upstream filter chamber 53, is lower than an outside pressure at the nozzle surface 80*a*, and is adjusted not to destroy the gas-liquid interface formed at the nozzle 81.

In addition, the difference between the pressure applied to the liquid in the subtank 30 and the pressure applied to the liquid in the upstream filter chamber 53 or the pressure applied to the liquid in the nozzle 81 may be formed not only by the water head difference but also, for example, by an air pressure applied to the liquid in the subtank 30 by the pressurizing module 36 or a supply pressure applied to the liquid in the subtank 30 by the supply pump 23.

After the drive of the diaphragm pump 40 is stopped in the step S502, and the discharge valve 59 is opened in the step S503, the control portion 100 may again perform the step S501 so that the discharge valve 59 is closed, and the diaphragm pump 40 is driven. That is, the diaphragm pump 40 may repeatedly perform the intermittent drive so as to repeatedly apply a force to the foreign materials for the removal thereof from the filter 52. Accordingly, since the foreign materials can be further removed from the inside of the filter 52, the filter 52 may have a long service life.

The air bubbles trapped by the filter 52 are stored in the upstream filter chamber 53. When those air bubbles are to be discharged through the deaeration path 58, without performing a pressurizing operation by the drive of the diaphragm pump 40, the closed discharge valve 59 may only be opened.

In the liquid ejecting apparatus 10, the liquid discharge path 33 may be omitted. In this case, the liquid supplied to the liquid ejection portion 80 by the drive of the diaphragm pump 40 is discharged from the nozzle 81.

In the state in which the subtank 30 is in non-communication with the filter portion 50 by closing the discharge valve 59, and the diaphragm pump 40 is driven, before the drive of the diaphragm pump 40 is stopped, the subtank 30 may be placed in communication with the filter portion 50 by opening the discharge valve 59.

When the pressure applied to the liquid in the subtank 30 is set so as to destroy the meniscus formed at the nozzle 81, the discharge valve 59 may be opened.

The cleaning of the filter portion 50 may be performed either before or after the pressure cleaning is performed. In addition, when the cleaning of the filter portion 50 is performed before the pressure cleaning is started, since the foreign materials passing through the filter portion 50 can be discharged from the nozzle 81 by the pressure cleaning, the clogging of the nozzle 81 can be suppressed. On the other hand, when the cleaning of the filter portion 50 is performed after the pressure cleaning, the clogging of the filter portion 50 generated by the pressure cleaning can be suppressed.

Hereinafter, technical concepts and advantages to be understood from the embodiments and the modified examples described above will be described.

A liquid ejecting apparatus comprises: a liquid supply path coupled to a liquid ejection portion to supply a liquid stored in a liquid storage portion to the liquid ejection portion; a pump provided for the liquid supply path and configured to supply the liquid to the liquid ejection portion; a filter portion which is provided between the pump and the liquid ejection portion as a part of the liquid supply path and which includes a filter configured to allow the liquid to pass therethrough and a filter chamber defined by the filter into an upstream filter chamber and a downstream filter chamber; a return path coupled to the upstream filter chamber and the liquid storage portion and configured to discharge a liquid in the upstream filter chamber to the liquid storage portion; a discharge valve located at the return path and configured to switch between a communication state in which the upstream filter chamber is in communication with the liquid storage portion and a non-communication state in which the upstream filter chamber is not in communication with the liquid storage portion; a pressure adjustment mechanism configured to adjust a pressure to be applied to the liquid in the liquid storage portion; and a control portion which switches, while the pump is driven in the non-communication state, the non-communication state to the communication state using the discharge valve, the non-communication state being placed such that the pressure to be applied to the liquid in the liquid storage portion is adjusted to be lower than an outside pressure at a nozzle surface of the liquid ejection portion and not to destroy a gas-liquid interface formed at a nozzle of the liquid ejection portion.

According to the structure described above, since the upstream filter chamber pressurized by the pump is in communication with the liquid storage portion at a lower pressure than that in the upstream filter chamber, the pressure in the upstream filter chamber is reduced. Hence, for example, the aggregates trapped by the filter are loosened into fine particles, and the foreign materials, such as fine particles and air bubbles, are likely to pass through the filter. Accordingly, the foreign materials trapped by the filter are likely to pass therethrough. In particular, since the foreign materials trapped by the filter can be removed therefrom, while air is suppressed from entering through the nozzle, the clogging of the filter can be suppressed.

In the liquid ejecting apparatus described above, after the drive of the pump is stopped in the non-communication state, the control portion may switch the non-communication state to the communication state using the discharge valve.

According to the structure described above, compared to the case in which while the pump is driven, the non-communication state is switched to the communication state through the return path, the pressure in the upstream filter chamber is likely to be reduced, and in addition, the drive time of the pump can be decreased.

In the liquid ejecting apparatus described above, after the communication state is again switched to the non-communication state, the control portion may drive the pressure adjustment mechanism to adjust the pressure to be applied to the liquid storage portion so as to destroy the gas-liquid interface formed at the nozzle.

According to the structure described above, since the pressure is applied to the nozzle so as to destroy the gas-liquid interface, the foreign materials which are made to easily pass through the filter are allowed to pass therethrough, and the foreign materials which pass through the filter can be discharged from the nozzle. Accordingly, the foreign materials causing the clogging of the filter can be discharged from the liquid path, and hence, the clogging of the filter can be further suppressed.

The liquid ejecting apparatus described above may further comprise a liquid discharge path coupled to the liquid ejection portion and the liquid storage portion and configured to discharge the liquid to be supplied to the liquid ejection portion to the liquid storage portion, and when the pump is driven such that the pressure to be applied to the liquid in the liquid storage portion is adjusted to be lower than the outside pressure at the nozzle surface and not to destroy the meniscus formed at the nozzle, the control portion may circulate the liquid through the liquid discharge path.

According to the structure described above, of the liquid to be supplied to the liquid ejection portion, a liquid which is not discharged from the nozzle is returned to the liquid storage portion, and hence, the consumption of the liquid can be reduced.

The liquid ejecting apparatus described above may further comprise a damper portion which is provided between the downstream filter chamber of the filter portion and the liquid ejection portion as a part of the liquid supply path and which includes a damper chamber having a wall partially composed of a flexible membrane.

According to the structure described above, by the pressure of the liquid in the liquid supply path, the flexible membrane is deformed. The deformation of the flexible membrane promotes the flow back of the liquid through the liquid supply path, and hence, the foreign materials are likely to be removed from the filter.

In a maintenance method of a liquid ejecting apparatus which comprises: a liquid supply path coupled to a liquid ejection portion to supply a liquid stored in a liquid storage portion to the liquid ejection portion; a pump provided for the liquid supply path and configured to supply the liquid to the liquid ejection portion; a filter portion which is provided between the pump and the liquid ejection portion as a part of the liquid supply path and which includes a filter configured to allow the liquid to pass therethrough and a filter chamber defined by the filter into an upstream filter chamber and a downstream filter chamber; a return path coupled to the upstream filter chamber and the liquid storage portion and configured to discharge a liquid in the upstream filter chamber to the liquid storage portion; a discharge valve located at the return path and configured to switch between a communication state in which the upstream filter chamber is in communication with the liquid storage portion and a non-communication state in which the upstream filter chamber is not in communication with the liquid storage portion; and a pressure adjustment mechanism configured to adjust a pressure to be applied to the liquid in the liquid storage portion, while the pump is driven in the non-communication state, the non-communication state is switched to the communication state using the discharge valve, the non-communication state being placed such that the pressure to be applied to the liquid in the liquid storage portion is adjusted to be lower than an outside pressure at a nozzle surface of the liquid ejection portion and not to destroy a gas-liquid interface formed at a nozzle of the liquid ejection portion.

According to the structure described above, since the upstream filter chamber pressurized by the pump is in communication with the liquid storage portion at a lower pressure than that in the upstream filter chamber, the pressure in the upstream filter chamber is reduced. Hence, for example, the aggregates trapped by the filter are loosened into fine particles, and the foreign materials, such as fine particles and air bubbles, are likely to pass through the filter. Accordingly, the foreign materials trapped by the filter are likely to pass through the filter. In particular, since the foreign materials trapped by the filter can be removed therefrom, while air is suppressed from entering through the nozzle, the clogging of the filter can be suppressed.

In the maintenance method of the liquid ejecting apparatus, after the drive of the pump is stopped in the non-communication state, the non-communication state may be switched to the communication state using the discharge valve.

According to this structure, compared to the case in which while the pump is driven, the non-communication state is switched to the communication state, the pressure in the upstream filter chamber is likely to be reduced, and in addition, the drive time of the pump can be decreased.

In the maintenance method of the liquid ejecting apparatus, after the communication state is again switched to the non-communication state, the pressure to be applied to the liquid in the liquid storage portion may be set to a pressure at which the gas-liquid interface formed at the nozzle is destroyed.

According to the structure described above, since the pressure is applied to the nozzle so as to destroy the gas-liquid interface, the foreign materials which are made to easily pass through the filter are allowed to pass therethrough, and the foreign materials which pass through the filter can be discharged from the nozzle. Accordingly, the foreign materials causing the clogging of the filter can be discharged from the liquid path, and hence, the clogging of the filter can be further suppressed.

In the maintenance method of the liquid ejecting apparatus, the liquid ejecting apparatus may further comprise a liquid discharge path coupled to the liquid ejection portion and the liquid storage portion and configured to discharge the liquid to be supplied to the liquid ejection portion to the liquid storage portion, and when the pump is driven such that the pressure to be applied to the liquid in the liquid storage portion is adjusted to be lower than the outside pressure at the nozzle surface and not to destroy the gas-liquid interface formed at the nozzle, the liquid may be circulated through the liquid discharge path.

According to this structure, of the liquid to be supplied to the liquid ejection portion, a liquid which is not discharged from the nozzle is returned to the liquid storage portion, and hence, the consumption of the liquid can be reduced.

What is claimed is:

1. A liquid ejecting apparatus comprising:

a liquid supply path coupled to a liquid ejection portion to supply a liquid stored in a liquid storage portion to the liquid ejection portion;

a pump provided for the liquid supply path and configured to supply the liquid to the liquid ejection portion;

a filter portion which is provided between the pump and the liquid ejection portion as a part of the liquid supply path and which includes a filter configured to allow the liquid to pass therethrough and a filter chamber defined by the filter into an upstream filter chamber and a downstream filter chamber;

a return path coupled to the upstream filter chamber and the liquid storage portion and configured to discharge a liquid in the upstream filter chamber to the liquid storage portion;

a discharge valve located at the return path and configured to switch between a communication state in which the upstream filter chamber is in communication with the liquid storage portion and a non-communication state in which the upstream filter chamber is not in communication with the liquid storage portion; and a control portion which switches, while the pump is driven in the non-communication state, the non-communication state to the communication state using the discharge valve.

2. The liquid ejecting apparatus according to claim 1, wherein after the drive of the pump is stopped in the non-communication state, the control portion switches the non-communication state to the communication state using the discharge valve.

3. The liquid ejecting apparatus according to claim 1, further comprising a pressure adjustment mechanism configured to adjust a pressure to be applied to the liquid in the liquid storage portion, wherein the control portion switches, while the pump is driven in the non-communication state, the non-communication state to the communication state using the discharge valve, the non-communication state being placed such that the pressure to be applied to the liquid in the liquid storage portion is adjusted to be lower than an outside pressure at a nozzle surface of the liquid ejection portion and not to destroy a gas-liquid interface formed at a nozzle of the liquid ejection portion.

4. The liquid ejecting apparatus according to claim 3, wherein after the communication state is again switched to the non-communication state, the control portion drives the pressure adjustment mechanism to adjust the pressure to be applied to the liquid storage portion so as to destroy the gas-liquid interface formed at the nozzle.

5. The liquid ejecting apparatus according to claim 3, further comprising a liquid discharge path coupled to the liquid ejection portion and the liquid storage portion and configured to discharge the liquid to be supplied to the liquid ejection portion to the liquid storage portion, wherein when the pump is driven such that the pressure to be applied to the liquid in the liquid storage portion is adjusted to be lower than the outside pressure at the nozzle surface and not to destroy the gas-liquid interface formed at the nozzle, the control portion circulates the liquid through the liquid discharge path.

6. The liquid ejecting apparatus according to claim 1, further comprising a damper portion which is provided between the downstream filter chamber of the filter portion and the liquid ejection portion as a part of the liquid supply path and which includes a damper chamber having a wall partially composed of a flexible membrane.

7. A maintenance method of a liquid ejecting apparatus which comprises:

a liquid supply path coupled to a liquid ejection portion to supply a liquid stored in a liquid storage portion to the liquid ejection portion;

a pump provided for the liquid supply path and configured to supply the liquid to the liquid ejection portion;

a filter portion which is provided between the pump and the liquid ejection portion as a part of the liquid supply path and which includes a filter configured to allow the liquid to pass therethrough and a filter chamber defined by the filter into an upstream filter chamber and a downstream filter chamber;

a return path coupled to the upstream filter chamber and the liquid storage portion and configured to discharge a liquid in the upstream filter chamber to the liquid storage portion; and a discharge valve located at the return path and configured to switch between a communication state in which the upstream filter chamber is in communication with the liquid storage portion and a non-communication state in which the upstream filter chamber is not in communication with the liquid storage portion, wherein while the pump is driven in the non-communication state, the non-communication state is switched to the communication state using the discharge valve.

8. The maintenance method of a liquid ejecting apparatus according to claim 7, wherein after the drive of the pump is stopped in the non-communication state, the non-communication state is switched to the communication state using the discharge valve.

9. The maintenance method of a liquid ejecting apparatus according to claim 7, wherein while the pump is driven in the non-communication state, the non-communication state is switched to the communication state using the discharge valve, the non-communication state being placed such that a pressure to be applied to the liquid in the liquid storage portion is adjusted to be lower than an outside pressure at a nozzle surface of the liquid ejection portion and not to destroy a gas-liquid interface formed at a nozzle of the liquid ejection portion.

10. The maintenance method of a liquid ejecting apparatus according to claim 9, wherein after the communication state is again switched to the non-communication state, the pressure to be applied to the liquid in the liquid storage portion is set to a pressure at which the gas-liquid interface formed at the nozzle is destroyed.

11. The maintenance method of a liquid ejecting apparatus according to claim 9, wherein the liquid ejecting apparatus further comprises a liquid discharge path coupled to the liquid ejection portion and the liquid storage portion and configured to discharge the liquid to be supplied to the liquid ejection portion to the liquid storage portion, and when the pump is driven such that the pressure to be applied to the liquid in the liquid storage portion is adjusted to be lower than the outside pressure at the nozzle surface and not to destroy the gas-liquid interface formed at the nozzle, the liquid is circulated through the liquid discharge path.

* * * * *